US011568797B2

(12) United States Patent
Liu et al.

(10) Patent No.: US 11,568,797 B2
(45) Date of Patent: Jan. 31, 2023

(54) LIGHT-EMITTING DRIVING CIRCUIT AND DRIVING METHOD THEREOF, AND LIGHT-EMITTING APPARATUS

(71) Applicant: BOE TECHNOLOGY GROUP CO., LTD., Beijing (CN)

(72) Inventors: Dongni Liu, Beijing (CN); Minghua Xuan, Beijing (CN); Haoliang Zheng, Beijing (CN); Li Xiao, Beijing (CN); Seungwoo Han, Beijing (CN); Liang Chen, Beijing (CN); Hao Chen, Beijing (CN); Jiao Zhao, Beijing (CN)

(73) Assignee: BOE TECHNOLOGY GROUP CO., LTD., Beijing (CN)

( * ) Notice: Subject to any disclaimer, the term of this patent is extended or adjusted under 35 U.S.C. 154(b) by 0 days.

(21) Appl. No.: 17/408,967

(22) Filed: Aug. 23, 2021

(65) Prior Publication Data

US 2022/0101779 A1 Mar. 31, 2022

(30) Foreign Application Priority Data

Sep. 30, 2020 (CN) ..... 202011067673.0

(51) Int. Cl.
*G09G 3/32* (2016.01)

(52) U.S. Cl.
CPC ..... *G09G 3/32* (2013.01); *G09G 2300/0842* (2013.01); *G09G 2310/027* (2013.01); *G09G 2310/0278* (2013.01)

(58) Field of Classification Search
CPC ..... G09G 3/32; G09G 2300/0842; G09G 2310/027; G09G 2310/0278
See application file for complete search history.

(56) References Cited

U.S. PATENT DOCUMENTS

2006/0176250 A1 8/2006 Nathan et al.
2010/0109985 A1 5/2010 Ono
2011/0141000 A1 6/2011 Han et al.
(Continued)

FOREIGN PATENT DOCUMENTS

CN 104167167 A 11/2014

OTHER PUBLICATIONS

Chinese First Office Action (w/ English translation) for corresponding Chinese Application No. 202011067673.0, dated Nov. 3, 2022, 20 pages.

*Primary Examiner* — Kenneth B Lee, Jr.
(74) *Attorney, Agent, or Firm* — Dority & Manning, P.A.

(57) ABSTRACT

A light-emitting driving circuit includes a driving sub-circuit, a control sub-circuit, a data writing sub-circuit and a compensation sub-circuit. The control sub-circuit is configured to initialize voltages of a first node and a control terminal of the driving sub-circuit in response to a second scan signal. The data writing sub-circuit is configured to write a data signal into a first terminal of the driving sub-circuit in response to a first scan signal. The driving sub-circuit is configured to output, from a second terminal of the driving sub-circuit, the data signal and a compensation signal. The compensation sub-circuit is configured to transmit the data signal and the compensation signal to the first node in response to the first scan signal, and adjust the voltage of the control terminal according to the data signal, the compensation signal, the initialized voltages of the first node and the control terminal.

19 Claims, 18 Drawing Sheets

(56) References Cited

U.S. PATENT DOCUMENTS

| | | | | |
|---|---|---|---|---|
| 2014/0118229 | A1 | 5/2014 | Han | |
| 2014/0139503 | A1 | 5/2014 | Han | |
| 2017/0116918 | A1 | 4/2017 | Dong et al. | |
| 2019/0237019 | A1* | 8/2019 | Gao | G09G 3/3233 |
| 2020/0051511 | A1* | 2/2020 | Wu | G09G 3/3258 |

* cited by examiner

LIGHT-EMITTING DRIVING CIRCUIT AND DRIVING METHOD THEREOF, AND LIGHT-EMITTING APPARATUS

CROSS-REFERENCE TO RELATED APPLICATION

This application claims priority to Chinese Patent Application No. 202011067673.0, filed on Sep. 30, 2020, which is incorporated herein by reference in its entirety.

TECHNICAL FIELD

The present disclosure relates to the field of display technologies, and in particular, to a light-emitting driving circuit and a driving method thereof, and a light-emitting apparatus.

BACKGROUND

Light-emitting devices, such as light-emitting diodes (LEDs), have the characteristics of self-luminescence, high contrast, and low power consumption, and are widely used in the display field.

SUMMARY

In one aspect, a light-emitting driving circuit is provided. The light-emitting driving circuit includes: a driving sub-circuit, a control sub-circuit coupled to a first node and a control terminal of the driving sub-circuit, a data writing sub-circuit coupled to a first terminal of the driving sub-circuit, and a compensation sub-circuit coupled to the first node, the control terminal and a second terminal of the driving sub-circuit. The control sub-circuit is configured to initialize a voltage of the first node and a voltage of the control terminal of the driving sub-circuit in response to a second scan signal. The data writing sub-circuit is configured to write a data signal into the first terminal of the driving sub-circuit in response to a first scan signal. The driving sub-circuit is configured to output, from the second terminal of the driving sub-circuit, the data signal and a compensation signal. The compensation sub-circuit is configured to transmit the data signal and the compensation signal to the first node in response to the first scan signal, and to adjust the voltage of the control terminal of the driving sub-circuit according to the data signal, the compensation signal, the initialized voltage of the first node and the initialized voltage of the control terminal of the driving sub-circuit. The driving sub-circuit is further configured to output a driving signal for driving a light-emitting device to emit light according to the adjusted voltage of the control terminal of the driving sub-circuit and a first voltage transmitted to the first terminal of the driving sub-circuit.

In some embodiments, the control sub-circuit includes: a second switching device coupled to a second node, a second capacitor coupled between the first node and the second node, and a third switching device coupled to the control terminal of the driving sub-circuit. The second switching device is configured to transmit a first signal to the second node in response to the second scan signal. The third switching device is configured to transmit a second signal to the control terminal of the driving sub-circuit in response to the second scan signal.

In some embodiments, the second switching device is a second transistor. A control electrode of the second transistor is configured to be coupled to a second scan signal terminal for providing the second scan signal, a first electrode of the second transistor is configured to be coupled to a first signal terminal for providing the first signal, and a second electrode of the second transistor is coupled to the second node.

In some embodiments, the third switching device is a third transistor. A control electrode of the third transistor is configured to be coupled to a second scan signal terminal for providing the second scan signal, a first electrode of the third transistor is configured to be coupled to a second signal terminal for providing the second signal, and a second electrode of the third transistor is coupled to the control terminal of the driving sub-circuit.

In some embodiments, the compensation sub-circuit includes a first switching device and a first capacitor. The first switching device is coupled between the first node and the second terminal of the driving sub-circuit. The first capacitor is coupled between the first node and the control terminal of the driving sub-circuit.

In some embodiments, the first switching device is a first transistor. A control electrode of the first transistor is configured to be coupled to a first scan signal terminal for providing the first scan signal, a first electrode of the first transistor is coupled to the second terminal of the driving sub-circuit, and a second electrode of the first transistor is coupled to the first node.

In some embodiments, the driving sub-circuit includes a driving transistor and a storage capacitor. A control electrode of the driving transistor is the control terminal of the driving sub-circuit, a first electrode of the driving transistor is the first terminal of the driving sub-circuit, and a second electrode of the driving transistor is the second terminal of the driving sub-circuit. A first terminal of the storage capacitor is coupled to the control electrode of the driving transistor, and a second terminal of the storage capacitor is configured to be coupled to a first voltage terminal for providing the first voltage.

In some embodiments, the data writing sub-circuit includes an eighth transistor. A control electrode of the eighth transistor is configured to be coupled to a first scan signal terminal for providing the first scan signal, a first electrode of the eighth transistor is configured to be coupled to a data signal terminal for providing the data signal, and a second electrode of the eighth transistor is coupled to the first terminal of the driving sub-circuit.

In some embodiments, the light-emitting driving circuit further includes a light-emitting control sub-circuit coupled to the driving sub-circuit. The light-emitting control sub-circuit is configured to control the driving sub-circuit to be communicated with a first voltage terminal for providing the first voltage and the light-emitting device in response to a light-emitting control signal.

In some embodiments, the light-emitting control sub-circuit includes a sixth transistor and a seventh transistor. A control electrode of the sixth transistor is configured to be coupled to a light-emitting control terminal for providing the light-emitting control signal, a first electrode of the sixth transistor is configured to be coupled to the first voltage terminal, and a second electrode of the sixth transistor is coupled to the first terminal of the driving sub-circuit. A control electrode of the seventh transistor is configured to be coupled to the light-emitting control terminal, a first electrode of the seventh transistor is coupled to the second terminal of the driving sub-circuit, and a second electrode of the seventh transistor is configured to be coupled to the light-emitting device.

In some embodiments, the light-emitting driving circuit further includes a reset sub-circuit coupled to the control terminal of the driving sub-circuit. The reset sub-circuit is configured to transmit an initialization signal to the control terminal of the driving sub-circuit in response to a reset signal, so as to reset the control terminal of the driving sub-circuit.

In some embodiments, the reset sub-circuit includes a fifth transistor. A control electrode of the fifth transistor is configured to be coupled to a reset signal terminal for providing the reset signal, a first electrode of the fifth transistor is configured to be coupled to an initialization signal terminal for providing the initialization signal, and a second electrode of the fifth transistor is coupled to the control terminal of the driving sub-circuit.

In some embodiments, the reset sub-circuit is further configured to be coupled to the light-emitting device, and to transmit the initialization signal to the light-emitting device in response to the reset signal, so as to reset the light-emitting device.

In some embodiments, the reset sub-circuit includes a fourth transistor and a fifth transistor. A control electrode of the fourth transistor is configured to be coupled to a reset signal terminal for providing the reset signal, a first electrode of the fourth transistor is configured to be coupled to an initialization signal terminal for providing the initialization signal, and a second electrode of the fourth transistor is configured to be coupled to the light-emitting device. A control electrode of the fifth transistor is configured to be coupled to the reset signal terminal, a first electrode of the fifth transistor is configured to be coupled to the initialization signal terminal, and a second electrode of the fifth transistor is coupled to the control terminal of the driving sub-circuit.

In some embodiments, the light-emitting driving circuit further includes a reset sub-circuit and a light-emitting control sub-circuit. The control sub-circuit includes a second transistor, a third transistor and a second capacitor. A control electrode of the second transistor is configured to be coupled to a second scan signal terminal for providing the second scan signal, a first electrode of the second transistor is configured to be coupled to a first signal terminal for providing a first signal, and a second electrode of the second transistor is coupled to a second node; a control electrode of the third transistor is configured to be coupled to the second scan signal terminal, a first electrode of the third transistor is configured to be coupled to a second signal terminal for providing a second signal, and a second electrode of the third transistor is coupled to the control terminal of the driving sub-circuit; and the second capacitor is coupled to the first node and the second node. The compensation sub-circuit includes a first transistor and a first capacitor. A control electrode of the first transistor is configured to be coupled to a first scan signal terminal for providing the first scan signal, a first electrode of the first transistor is coupled to the second terminal of the driving sub-circuit, and a second electrode of the first transistor is coupled to the first node; and the first capacitor is coupled between the first node and the control terminal of the driving sub-circuit. The driving sub-circuit includes a driving transistor and a storage capacitor. A control electrode of the driving transistor is the control terminal of the driving sub-circuit, a first electrode of the driving transistor is the first terminal of the driving sub-circuit, and a second electrode of the driving transistor is the second terminal of the driving sub-circuit; and a first terminal of the storage capacitor is coupled to the control electrode of the driving transistor, and a second terminal of the storage capacitor is configured to be coupled to a first voltage terminal for providing the first voltage. The data writing sub-circuit includes an eighth transistor. A control electrode of the eighth transistor is configured to be coupled to the first scan signal terminal for providing the first scan signal, a first electrode of the eighth transistor is configured to be coupled to a data signal terminal for providing the data signal, and a second electrode of the eighth transistor is coupled to the first terminal of the driving sub-circuit. The light-emitting control sub-circuit includes a sixth transistor and a seventh transistor. A control electrode of the sixth transistor is configured to be coupled to a light-emitting control terminal for providing a light-emitting control signal, a first electrode of the sixth transistor is configured to be coupled to the first voltage terminal, and a second electrode of the sixth transistor is coupled to the first terminal of the driving sub-circuit; and a control electrode of the seventh transistor is configured to be coupled to the light-emitting control terminal, a first electrode of the seventh transistor is coupled to the second terminal of the driving sub-circuit, and a second electrode of the seventh transistor is configured to be coupled to the light-emitting device. The reset sub-circuit includes a fourth transistor and a fifth transistor. A control electrode of the fourth transistor is configured to be coupled to a reset signal terminal for providing a reset signal, a first electrode of the fourth transistor is configured to be coupled to an initialization signal terminal for providing an initialization signal, and a second electrode of the fourth transistor is configured to be coupled to the light-emitting device; and a control electrode of the fifth transistor is configured to be coupled to the reset signal terminal, a first electrode of the fifth transistor is configured to be coupled to the initialization signal terminal, and a second electrode of the fifth transistor is coupled to the control terminal of the driving sub-circuit.

In another aspect, a light-emitting apparatus is provided. The light-emitting apparatus includes a plurality of light-emitting driving circuits as described in any of the above embodiments, and a plurality of light-emitting devices. The light-emitting driving circuit is coupled to a first electrode of the light-emitting device, and a second electrode of the light-emitting device is coupled to a second voltage terminal for providing a second voltage.

In yet another aspect, a driving method of a light-emitting driving circuit is provided. The light-emitting driving circuit is the light-emitting driving circuit as described in any of the above embodiments. The driving method includes: initializing, by the control sub-circuit, the voltage of the first node and the voltage of the control terminal of the driving sub-circuit, in response to the second scan signal; writing, by the data writing sub-circuit, the data signal into the first terminal of the driving sub-circuit, in response to the first scan signal; outputting, from the second terminal of the driving sub-circuit, the data signal and the compensation signal; transmitting, by the compensation sub-circuit, the data signal and the compensation signal to the first node, in response to the first scan signal; adjusting, by the compensation sub-circuit, the voltage of the control terminal of the driving sub-circuit according to the data signal, the compensation signal, the initialized voltage of the first node and the initialized voltage of the control terminal of the driving sub-circuit; and outputting, by the driving sub-circuit, the driving signal for driving the light-emitting device to emit light, according to the adjusted voltage of the control terminal of the driving sub-circuit and the first voltage transmitted to the first terminal of the driving sub-circuit.

In some embodiments, the control sub-circuit includes a second switching device, a third switching device and a second capacitor. Initializing, by the control sub-circuit, the voltage of the first node and the voltage of the control terminal of the driving sub-circuit in response to the second scan signal includes: transmitting, by the second switching device, a first signal to a second node, in response to the second scan signal; transmitting, by the third switching device, a second signal to the control terminal of the driving sub-circuit, in response to the second scan signal; and controlling, by the second capacitor, the voltage of the first node, according to the voltage of the second node.

In some embodiments, the first signal is the same as the data signal, and the first signal is different from the second signal.

In some embodiments, the light-emitting driving circuit further includes a reset sub-circuit and a light-emitting control sub-circuit. The driving method further includes: transmitting, by the reset sub-circuit, an initialization signal to the control terminal of the driving sub-circuit, in response to a reset signal; transmitting, by the reset sub-circuit, the initialization signal to the light-emitting device, in response to the reset signal; transmitting, by the light-emitting control sub-circuit, the first voltage to the driving sub-circuit, in response to a light-emitting control signal; and transmitting, by the light-emitting control sub-circuit, the driving signal to the light-emitting device, in response to the light-emitting control signal.

BRIEF DESCRIPTION OF THE DRAWINGS

In order to describe technical solutions in the present disclosure more clearly, the accompanying drawings to be used in some embodiments of the present disclosure will be introduced briefly below. However, the accompanying drawings to be described below are merely accompanying drawings of some embodiments of the present disclosure, and a person of ordinary skill in the art can obtain other drawings according to these drawings. In addition, the accompanying drawings in the following description can be regarded as schematic diagrams, and are not limitations on actual dimensions of products, actual processes of methods and actual timings of signals involved in the embodiments of the present disclosure.

DETAILED DESCRIPTION

Technical solutions in some embodiments of the present disclosure will be described clearly and completely below with reference to the accompanying drawings. However, the described embodiments are merely some but not all embodiments of the present disclosure. All other embodiments obtained on a basis of the embodiments of the present disclosure by a person of ordinary skill in the art shall be included in the protection scope of the present disclosure.

Unless the context requires otherwise, throughout the description and the claims, the term "comprise" and other forms thereof such as the third-person singular form "comprises" and the present participle form "comprising" are construed as an open and inclusive meaning, i.e., "including, but not limited to." In the description of the specification, the terms such as "one embodiment", "some embodiments", "exemplary embodiments", "example", "specific example" or "some examples" are intended to indicate that specific features, structures, materials or characteristics related to the embodiment(s) or example(s) are included in at least one embodiment or example of the present disclosure. Schematic representations of the above terms do not necessarily refer to the same embodiment(s) or examples(s). In addition, the specific features, structures, materials or characteristics may be included in any or more embodiments or examples in any suitable manner.

Hereinafter, the terms such as "first" and "second" are only used for descriptive purposes, and are not to be construed as indicating or implying relative importance or implicitly indicating the number of indicated technical features. Thus, a feature defined with "first" or "second" may explicitly or implicitly include one or more of the features. In the description of the embodiments of the present disclosure, the term "a/the plurality of" means two or more unless otherwise specified.

In the description of some embodiments, the terms "coupled" and "connected" and their derivatives may be used. For example, the term "connected" may be used in the description of some embodiments to indicate that two or more components are in direct physical or electrical contact with each other. For another example, the term "coupled" may be used in the description of some embodiments to indicate that two or more components are in direct physical or electrical contact. However, the term "coupled" may also mean that two or more components are not in direct contact with each other but still cooperate or interact with each other. The embodiments disclosed herein are not necessarily limited to the contents herein.

Use of the phrase "configured to" is meant as an open and inclusive expression, which does not exclude devices configured to perform additional tasks or steps.

Figure 14:
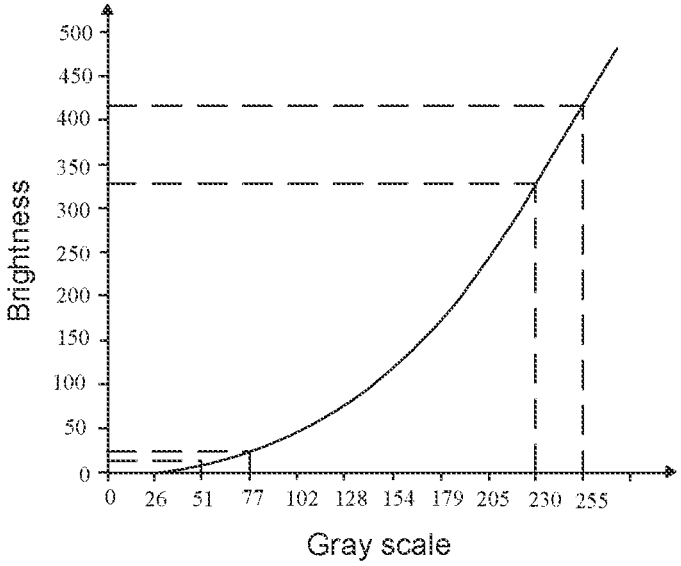
FIG. 14 is a Gamma curve graph, in accordance with some embodiments.

In some examples, a Gamma curve graph as shown in FIG. 14 is obtained by performing Gamma adjustment on a self-luminous light-emitting apparatus, where the abscissa represents gray scale and the ordinate represents brightness. For example, each gray scale corresponds to a data signal, the data signal corresponds to a driving signal, and when a light-emitting device in the light-emitting apparatus emits light according to the driving signal, a brightness of the light-emitting device is a brightness corresponding to the gray scale. As shown in FIG. 14, a slope of a portion of the Gamma curve corresponding to high gray scales is much greater than a slope of a portion of the Gamma curve corresponding to low gray scales. For example, a slope of a portion of the Gamma curve in a range from 230 gray scale to 255 gray scale is greater than a slope of a portion of the Gamma curve in a range from 51 gray scale to 77 gray scale; and a difference between a brightness when the 230 gray scale is displayed and a brightness when the 255 gray scale is displayed is larger than a difference between a brightness when the 51 gray scale is displayed and a brightness when the 77 gray scale is displayed.

In this case, when different high gray scales (e.g., two adjacent high gray scales) are displayed, a difference between two brightnesses corresponding to the two high gray scales is large, and a difference between two data voltages of two corresponding data signals is large. When different low gray scales (e.g., two adjacent low gray scales) are displayed, a difference between two brightnesses corresponding to the two low gray scales is small, and a difference between two data voltages of two corresponding data signals is small. As can be seen from the above, a range within which the data voltage can be adjusted is large when a high gray scale is displayed, and a range within which the data voltage can be adjusted is small when a low gray scale is displayed.

Therefore, when the light-emitting apparatus displays a low gray scale, more finely divided data voltages are needed to realize a corresponding low gray scale display. However, for the current light-emitting apparatus, due to the influence of cost and process, the minimum data voltage is limited (that is, the minimum data voltage output by a device for outputting the data voltage is limited), and thus the data voltage cannot be divided more finely when a low gray scale is displayed, resulting in deviation of gray scale and brightness that does not satisfy the Gamma curve.

Some embodiments of the present disclosure provide a light-emitting apparatus. The light-emitting apparatus may be a lighting apparatus or a display apparatus.

In some examples, the light-emitting apparatus is the lighting apparatus, which is used as a light source to realize a lighting function. For example, the light-emitting apparatus is a backlight module in a liquid crystal display apparatus, a lamp for lighting or a signal lamp.

In some other examples, the light-emitting apparatus is the display apparatus for displaying images. The light-emitting apparatus may be a display or a product including a display. The display may be a flat panel display (FPD), a micro display, etc. For example, the display is a transparent display or an opaque display. For another example, the display may be a flexible display or a general display (which may be referred to as a rigid display). The product including the display may be a computer monitor, a television, a billboard, a laser printer with a display function, a telephone, a mobile phone, a tablet computer, a vehicle-mounted computer, a personal digital assistant (PDA), a laptop computer, a digital camera, a portable video camera, a wearable display device, a viewfinder, a theater screen or a stadium sign, etc. Embodiments of the present disclosure do not particularly limit a specific form of the light-emitting apparatus.

Figure 1:
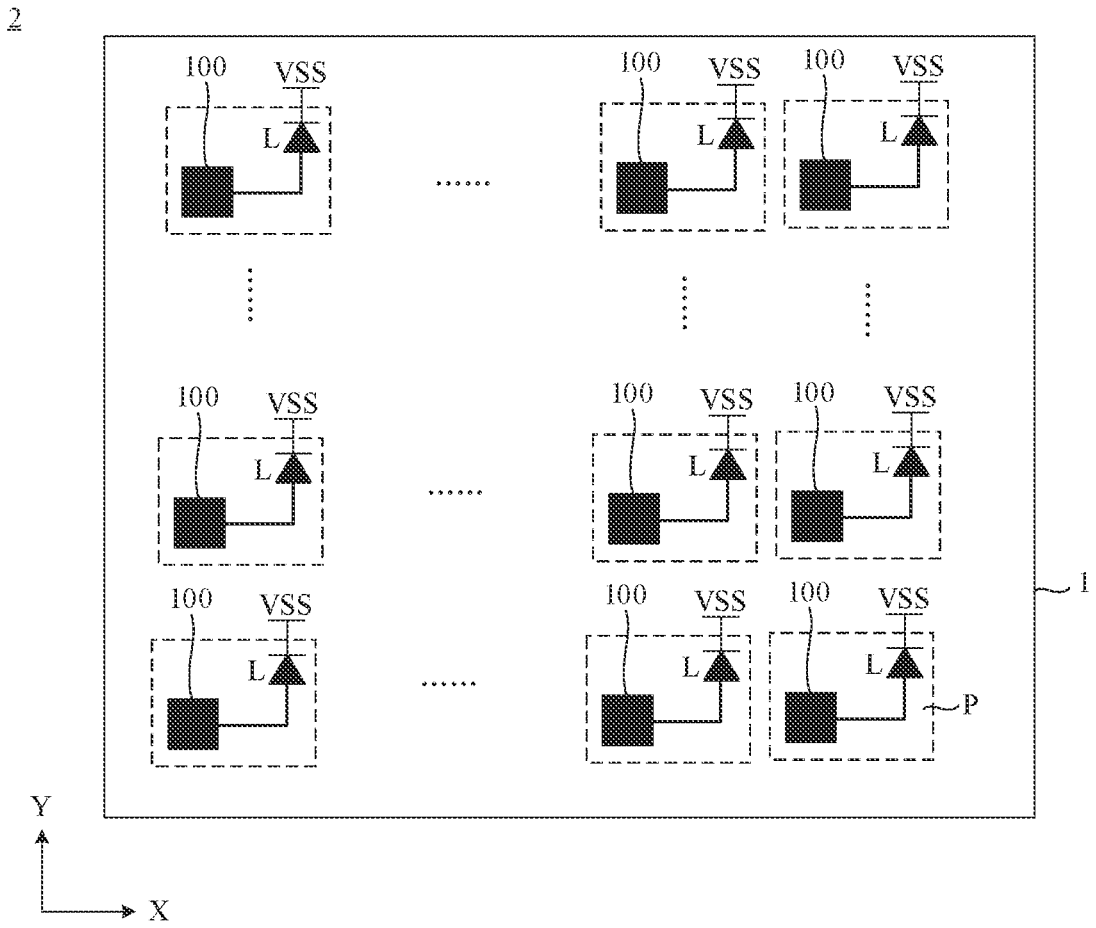
FIG. 1 is a schematic diagram of a light-emitting apparatus, in accordance with some embodiments.

In some embodiments, as shown in FIG. 1, the light-emitting apparatus 2 includes a plurality of light-emitting driving circuits 100 and a plurality of light-emitting devices L. A light-emitting device L is coupled to one light-emitting driving circuit 100. For example, each light-emitting device L is coupled to a respective one of the plurality of light-emitting driving circuits 100. The light-emitting driving circuit 100 is configured to provide a driving signal to the light-emitting device L, so as to drive the light-emitting device L to emit light.

As shown in FIG. 1, the light-emitting device L is further coupled to a second voltage terminal VSS. The second voltage terminal VSS is configured to transmit a direct current voltage signal, such as a low-level direct current voltage signal.

In some examples, a first electrode of the light-emitting device L is coupled to the light-emitting driving circuit 100, and a second electrode of the light-emitting device L is coupled to the second voltage terminal VSS. For example, the first electrode of the light-emitting device L is an anode, and the second electrode of the light-emitting device L is a cathode.

In some embodiments, the light-emitting devices L may be current-driven light-emitting devices, such as light-emitting diodes (LEDs), micro light-emitting diodes (Micro LEDs), mini light-emitting diodes (Mini LEDs), organic light-emitting diodes (OLEDs) or quantum light-emitting diodes (QLEDs). Of course, the light-emitting devices L may also be voltage-driven light-emitting devices, which are not limited in the embodiments of the present disclosure.

Figure 2:
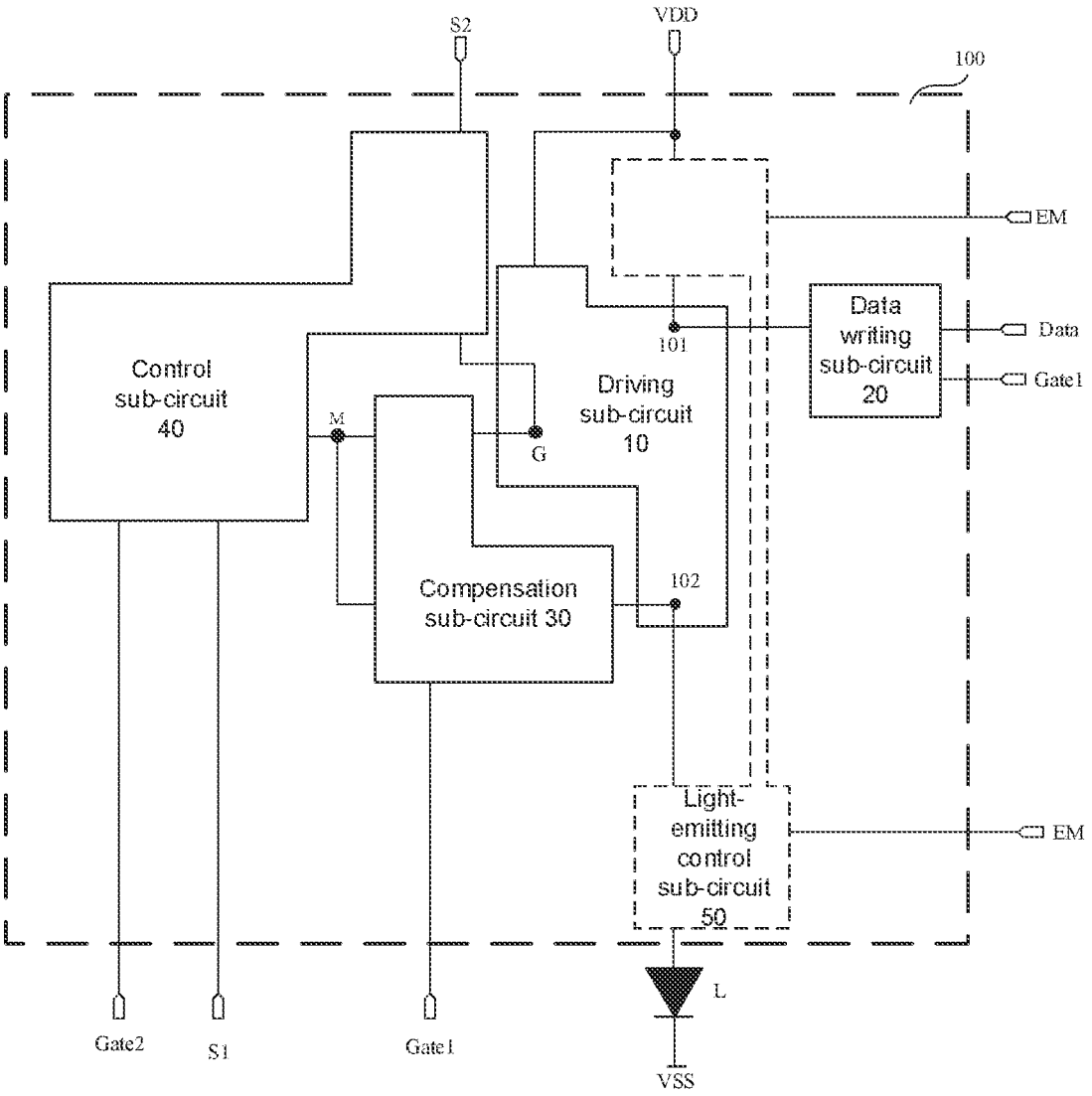
FIG. 2 is a block diagram of a light-emitting driving circuit, in accordance with some embodiments.

As shown in FIG. 2, the light-emitting driving circuit 100 provided in some embodiments of the present disclosure includes: a driving sub-circuit 10, a data writing sub-circuit 20, a compensation sub-circuit 30 and a control sub-circuit 40.

The control sub-circuit 40 is coupled to a first node M and a control terminal G of the driving sub-circuit 10. The data writing sub-circuit 20 is coupled to a first terminal 101 of the driving sub-circuit 10. The compensation sub-circuit 30 is coupled to the first node M and the control terminal G and a second terminal 102 of the driving sub-circuit 10.

The control sub-circuit 40 is configured to initialize a voltage of the first node M and a voltage of the control terminal G of the driving sub-circuit 10 in response to a second scan signal.

The data writing sub-circuit 20 is configured to write a data signal into the driving sub-circuit 10 in response to a first scan signal. The driving sub-circuit 10 is configured to output, from the second terminal 102 of the driving sub-circuit 10, the data signal written into the first terminal 101 of the driving sub-circuit 10 and a compensation signal.

The compensation sub-circuit 30 is configured to transmit the data signal and the compensation signal to the first node M in response to the first scan signal, and to adjust the voltage of the control terminal G of the driving sub-circuit 10 according to the data signal, the compensation signal, the initialized voltage of the first node M and the initialized voltage of the control terminal G of the driving sub-circuit 10.

The driving sub-circuit 10 is further configured to output a driving signal for driving the light-emitting device L to emit light, according to the adjusted voltage of the control terminal G and a first voltage from the a first voltage terminal VDD transmitted to the first terminal 101.

For example, referring to FIG. 2, the second scan signal is provided by a second scan signal terminal Gate2. That is, the second scan signal terminal Gate2 is configured to transmit the second scan signal. The control sub-circuit 40 is coupled to the second scan signal terminal Gate2.

For example, referring to FIG. 2, the first scan signal is provided by a first scan signal terminal Gate1. That is, the first scan signal terminal Gate1 is configured to transmit the first scan signal. The data writing sub-circuit 20 and the compensation sub-circuit 30 are both coupled to the first scan signal terminal Gate1.

For example, referring to FIG. 2, the data signal is provided by a data signal terminal Data. That is, the data signal terminal Data is configured to transmit the data signal. The data writing sub-circuit 20 is coupled to the data signal terminal Data.

For example, referring to FIG. 2, the first voltage is provided by the first voltage terminal VDD. That is, the first voltage terminal VDD is configured to transmit the first voltage. For example, the first voltage is a direct current voltage, such as a high-level direct current voltage.

In the light-emitting driving circuit 100 provided in the embodiments of the present disclosure, the control sub-circuit 40 initializes the voltage of the first node M and the voltage of the control terminal G of the driving sub-circuit 10, so that the first node M and the control terminal G of the driving sub-circuit 10 each have initial voltage. The data writing sub-circuit 20 writes the data signal into the driving sub-circuit 10, and the driving sub-circuit 10 output the data signal and the compensation signal. The compensation sub-circuit 30 inputs the data signal and the compensation signal to the first node M, and adjusts the voltage of the control terminal G of the driving sub-circuit 10 according to the data signal, the compensation signal, the initialized voltage of the first node M and the initialized voltage of the control terminal G of the driving sub-circuit 10. In this way, after the data signal and the compensation signal are input, the voltage of the control terminal G of the driving sub-circuit 10 is related to the data signal, the compensation signal, the initialized voltage of the first node M and the initialized voltage of the control terminal G, and the driving sub-circuit 10 outputs the driving signal according to the adjusted voltage of the control terminal G and the first voltage transmitted to the first terminal 101, so as to drive the light-emitting device L to emit light.

Based on this, after the data signal and the compensation signal are input, compared to a case where the voltage of the control terminal G of the driving sub-circuit 10 is only related to the data signal and the compensation signal, the voltage of the control terminal G of the driving sub-circuit 10 in the light-emitting driving circuit 100 in the embodiments of the present disclosure is adjusted according to the data signal, the compensation signal, the initialized voltage of the first node M and the initialized voltage of the control terminal G, so that the voltage of the control terminal G of the driving sub-circuit 10 may be finely adjusted (e.g., may be finely reduced). In this way, when displaying a low gray scale, the light-emitting device L may obtain a smaller driving signal. Therefore, the driving signal corresponding to the low gray scale may be finely adjusted, and the brightness and the gray scale of the light-emitting device L are more in line with the Gamma curve.

Figure 3:
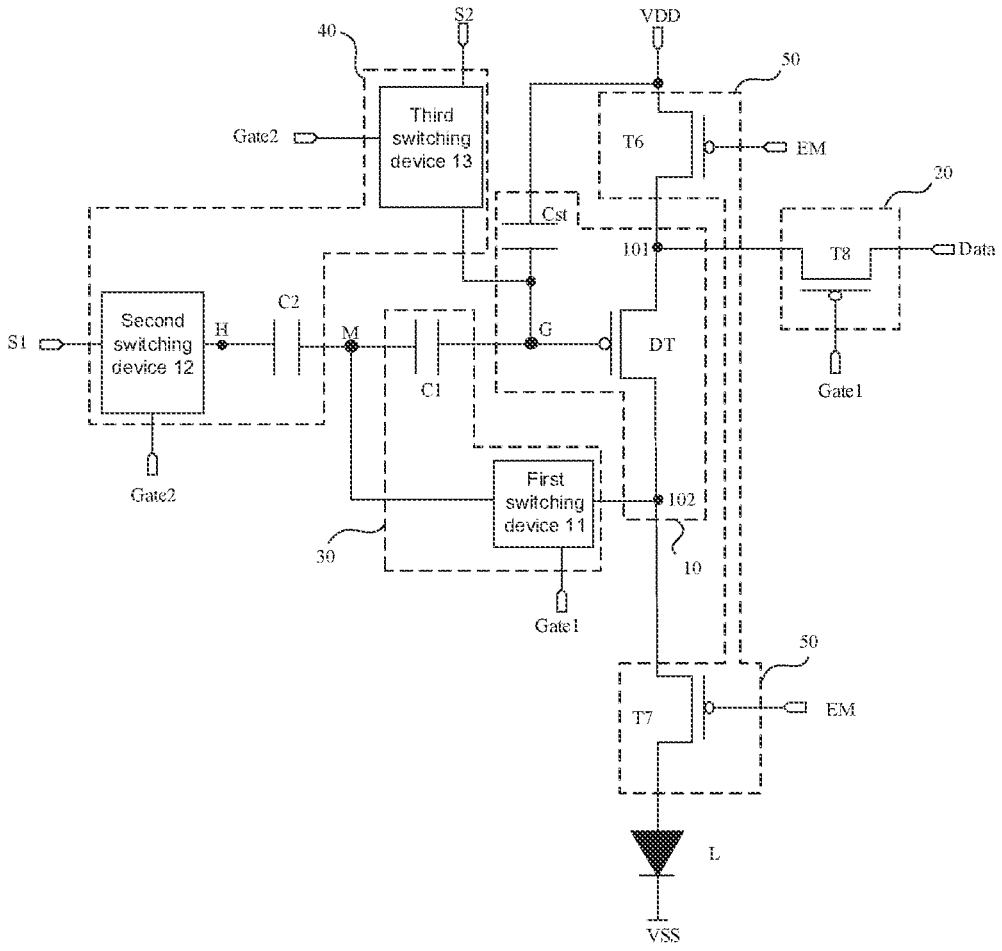
FIG. 3 is a schematic diagram of a light-emitting driving circuit, in accordance with some embodiments.

In some embodiments, referring to FIG. 3, the control sub-circuit 40 includes a second capacitor C2, a second switching device 12 and a third switching device 13.

The second switching device 12 is coupled to a second node H. The second capacitor C2 is coupled between the first node M and the second node H. That is, a first terminal of the second capacitor C2 is coupled to second node H, and a second terminal of the second capacitor C2 is coupled to the first node M. The third switching device 13 is coupled to the control terminal G of the driving sub-circuit 10.

The second switching device 12 is configured to write a first signal into the second node H in response to the second scan signal. The third switching device 13 is configured to write a second signal into the control terminal G of the driving sub-circuit 10 in response to the second scan signal. In this case, the control terminal G of the driving sub-circuit 10 is initialized, and the initialized voltage of the control terminal G of the driving sub-circuit 10 is a voltage of the second signal. The second capacitor C2 is configured to initialize the voltage of the first node M according to a voltage of the second node H.

For example, referring to FIG. 3, the first signal is provided by a first signal terminal S1, that is, the first signal terminal S1 is configured to transmit the first signal. In this case, the second switching device 12 is further coupled to the first signal terminal S1. That is, the control sub-circuit 40 is further coupled to the first signal terminal S1, so as to receive the first signal.

Referring to FIG. 3, the second signal is provided by a second signal terminal S2, that is, the second signal terminal S2 is configured to transmit the second signal. In this case, the third switching device 13 is further coupled to the second signal terminal S2. That is, the control sub-circuit 40 is further coupled to the second signal terminal S2, so as to receive the second signal. In some examples, the second signal is a direct current voltage signal. For example, the voltage of the second signal is in a range from −5 V to 5 V, such as −5 V, −3 V, −2 V, −1 V, 0V, 1 V, 3V or 5V.

In addition, the second switching device 12 and the third switching device 13 may also be coupled to the second scan signal terminal Gate2 to receive the second scan signal.

In this case, the second switching device 12 transmits the first signal from the first signal terminal S1 to the second node H in response to the second scan signal from the second scan signal terminal Gate2, so that the voltage of the second node H is the voltage of the first signal. The third switching device 13 transmits the second signal from the second signal terminal S2 to the control terminal G of the driving sub-circuit 10 in response to the second scan signal from the second scan signal terminal Gate2, so that the voltage of the control terminal G of the driving sub-circuit 10 is the voltage of the second signal. That is, the initialized voltage of the control terminal G of the driving sub-circuit 10 is the voltage of the second signal, and a voltage of the first terminal of the second capacitor C2 is the voltage of the second node H, i.e., the voltage of the first signal. Since the second capacitor C2 can adjust a voltage of the second terminal of the second capacitor C2 according to the voltage of the first terminal of the second capacitor C2, the initialized voltage of the first node M is related to the voltage of the second node H. That is, the initialized voltage of the first node M is related to the voltage of the first signal.

In some embodiments, the first signal is the same as the data signal. In this case, the voltage of the first signal is the same as the voltage of the data signal.

In some embodiments, the first signal is different from the second signal. For example, the voltage of the first signal is different from the voltage of the second signal. For example, the second signal is a direct current voltage signal, and the first signal is a data signal.

Figure 4:
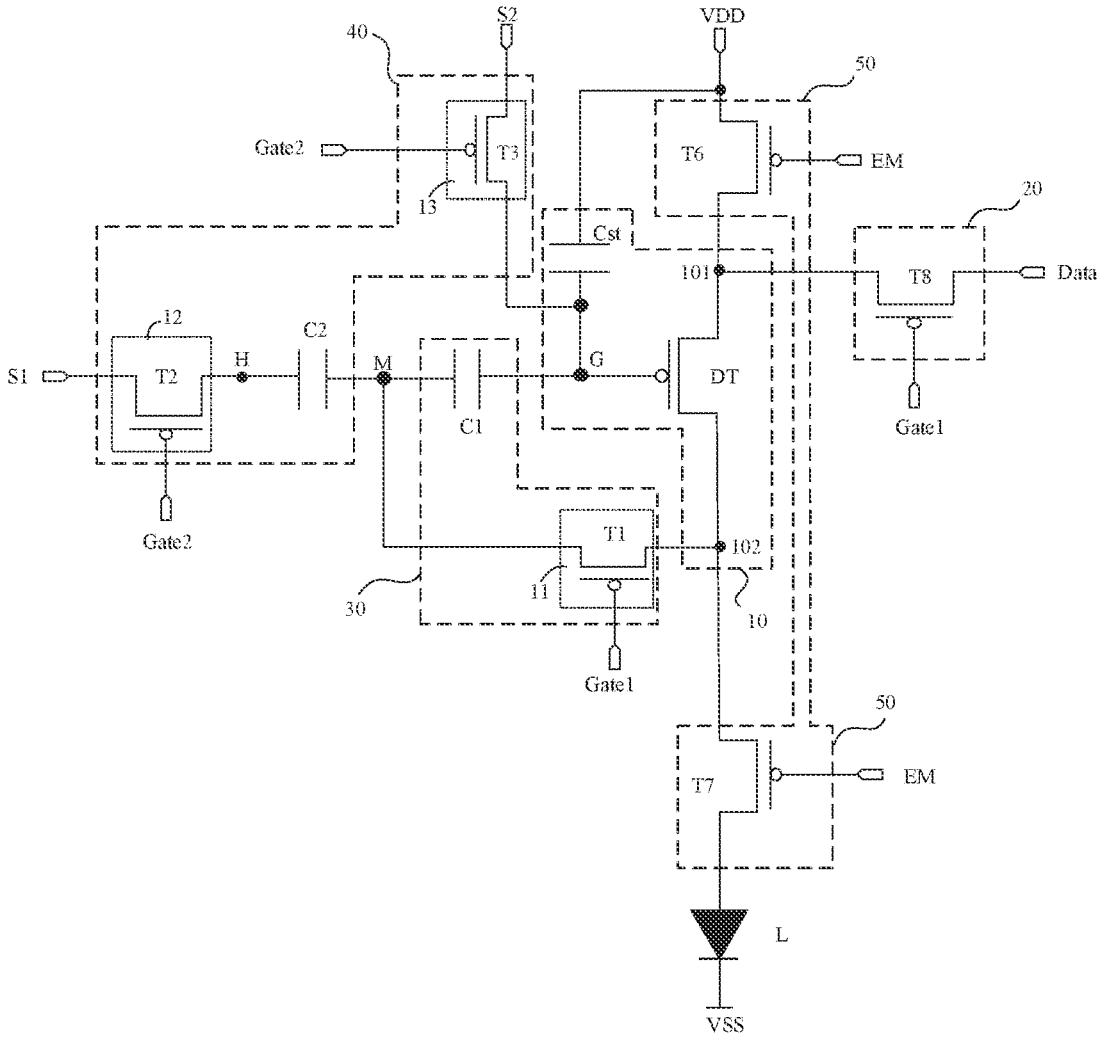
FIG. 4 is a circuit diagram of a light-emitting driving circuit, in accordance with some embodiments.

In some examples, as shown in FIG. 4, the second switching device 12 is a second transistor T2. A control electrode of the second transistor T2 is configured to be coupled to the second scan signal terminal Gate2, a first electrode of the second transistor T2 is configured to be coupled to the first signal terminal S1, and a second electrode of the second transistor T2 is coupled to the second node H. In this way, when the second transistor T2 is turned on in response to the second scan signal from the second scan signal terminal Gate2, the second transistor T2 transmits the first signal from the first signal terminal S1 to the second node H, so that the voltage of the second node H is the voltage of the first signal.

In some examples, as shown in FIG. 4, the third switching device 13 is a third transistor T3. A control electrode of the third transistor T3 is configured to be coupled to the second scan signal terminal Gate2, a first electrode of the third transistor T3 is configured to be coupled to the second signal terminal S2, and a second electrode of the third transistor T3 is coupled to the control terminal G of the driving sub-circuit 10. In this way, when the third transistor T3 is turned on in response to the second scan signal from the second scan signal terminal Gate2, the third transistor T3 transmits the second signal from the second signal terminal S2 to the control terminal G of the driving sub-circuit 10, so that the voltage of the control terminal G of the driving sub-circuit 10 is the voltage of the second signal.

In some embodiments, as shown in FIG. 3, the compensation sub-circuit 30 includes a first switching device 11 and a first capacitor C1. The first capacitor C1 is coupled between the first node M and the control terminal G of the driving sub-circuit 10. That is, a first terminal of the first capacitor C1 is coupled to the first node M, and a second terminal of the first capacitor C1 is coupled to the control terminal G of the driving sub-circuit 10. The first switching device 11 is coupled between the first node M and the second terminal 102 of the driving sub-circuit 10, and the first switching device 11 is configured to be coupled to the first scan signal terminal Gate1 to receive the first scan signal.

The first switching device 11 is further configured to transmit the data signal and the compensation signal to the first node M in response to the first scan signal. The first capacitor C1 is configured to adjust the voltage of the control terminal G of the driving sub-circuit 10 according to the voltage of the first node M after the data signal and the compensation signal are input, so that after the data signal and the compensation signal are input, the voltage of the control terminal G of the driving sub-circuit 10 is related to the data signal, the compensation signal, the initialized voltage of the first node M and the initialized voltage of the control terminal G of the driving sub-circuit 10.

The first capacitor C1 and the second capacitor C2 are connected in series, a connection point between the first capacitor C1 and the second capacitor C2 is the first node M, and two terminals of the series structure are the control terminal G of the driving sub-circuit 10 and the second node H. Therefore, the series structure composed of the first capacitor C1 and the second capacitor C2 divides voltages of the two terminals. That is, the first capacitor C1 and the second capacitor C2 divide the voltages of the control terminal G of the driving sub-circuit 10 and the second node H, so as to obtain the voltage of the first node M (i.e., the initialized voltage of the first node M).

In some examples, as shown in FIG. 4, the first switching device 11 is a first transistor T1. A control electrode of the first transistor T1 is configured to be coupled to the first scan signal terminal Gate1, a first electrode of the first transistor T1 is coupled to the second terminal 102 of the driving sub-circuit 10, and a second electrode of the first transistor T1 is coupled to the first node M.

In some embodiments, as shown in FIGS. 3 and 4, the driving sub-circuit 10 includes a driving transistor DT and a storage capacitor Cst. A control electrode of the driving transistor DT is the control terminal G of the driving sub-circuit 10, a first electrode of the driving transistor DT is the first terminal 101 of the driving sub-circuit 10, and a second electrode of the driving transistor DT is the second terminal 102 of the driving sub-circuit 10. A first terminal of the storage capacitor Cst is coupled to the control electrode of the driving transistor DT, and a second terminal of the storage capacitor Cst is configured to be coupled to the first voltage terminal VDD for providing the first voltage.

In this case, the data writing sub-circuit 20 writes the data signal into the first electrode of the driving transistor DT, the second electrode of the driving transistor DT outputs the data signal and the compensation signal, and thus a voltage of the second electrode of the driving transistor DT is a sum of the voltage of the data signal and a voltage of the compensation signal. The compensation signal is a signal that is used to compensate for a threshold voltage of the driving transistor. For example, the voltage of the compensation signal is the threshold voltage of the driving transistor DT.

In some embodiments, as shown in FIGS. 3 and 4, the data writing sub-circuit 20 includes an eighth transistor T8. A control electrode of the eighth transistor T8 is configured to be coupled to the first scan signal terminal Gate1, a first electrode of the eighth transistor T8 is configured to be coupled to the data signal terminal Data, and a second electrode of the eighth transistor T8 is coupled to the first electrode of the driving transistor DT (i.e., the first terminal 101 of the driving sub-circuit 10).

In some embodiments, as shown in FIG. 2, the light-emitting driving circuit 100 further includes a light-emitting control sub-circuit 50 coupled to the driving sub-circuit 10. The light-emitting control sub-circuit 50 is configured to control the driving sub-circuit 10 to be communicated with the first voltage terminal VDD and the light-emitting device L (e.g., the first electrode of the light-emitting device L) in response to a light-emitting control signal. In this way, the first voltage from the first voltage terminal VDD can be transmitted to the driving sub-circuit 10, and the driving signal from the driving sub-circuit 10 can be transmitted to the light-emitting device L.

Referring to FIG. 2, the light-emitting control signal is provided by a light-emitting control terminal EM, that is, the light-emitting control terminal EM is configured to transmit the light-emitting control signal. In this case, the light-emitting control sub-circuit 50 may be coupled to the light-emitting control terminal EM and the first voltage terminal VDD.

In some examples, as shown in FIGS. 3 and 4, the light-emitting control sub-circuit 50 includes a sixth transistor T6. A control electrode of the sixth transistor T6 is configured to be coupled to the light-emitting control terminal EM, a first electrode of the sixth transistor T6 is configured to be coupled to the first voltage terminal VDD, and a second electrode of the sixth transistor T6 is coupled to the first electrode of the driving transistor DT (i.e., the first terminal 101 of the driving sub-circuit 10).

As shown in FIGS. 3 and 4, the light-emitting control sub-circuit 50 further includes a seventh transistor T7. A control electrode of the seventh transistor T7 is configured to be coupled to the light-emitting control terminal EM, a first electrode of the seventh transistor T7 is coupled to the second electrode of the driving transistor DT (i.e., the second terminal 102 of the driving sub-circuit 10), and a second electrode of the seventh transistor T7 is configured to be coupled to the light-emitting device L (e.g., the first electrode of the light-emitting device L).

Figure 5A:
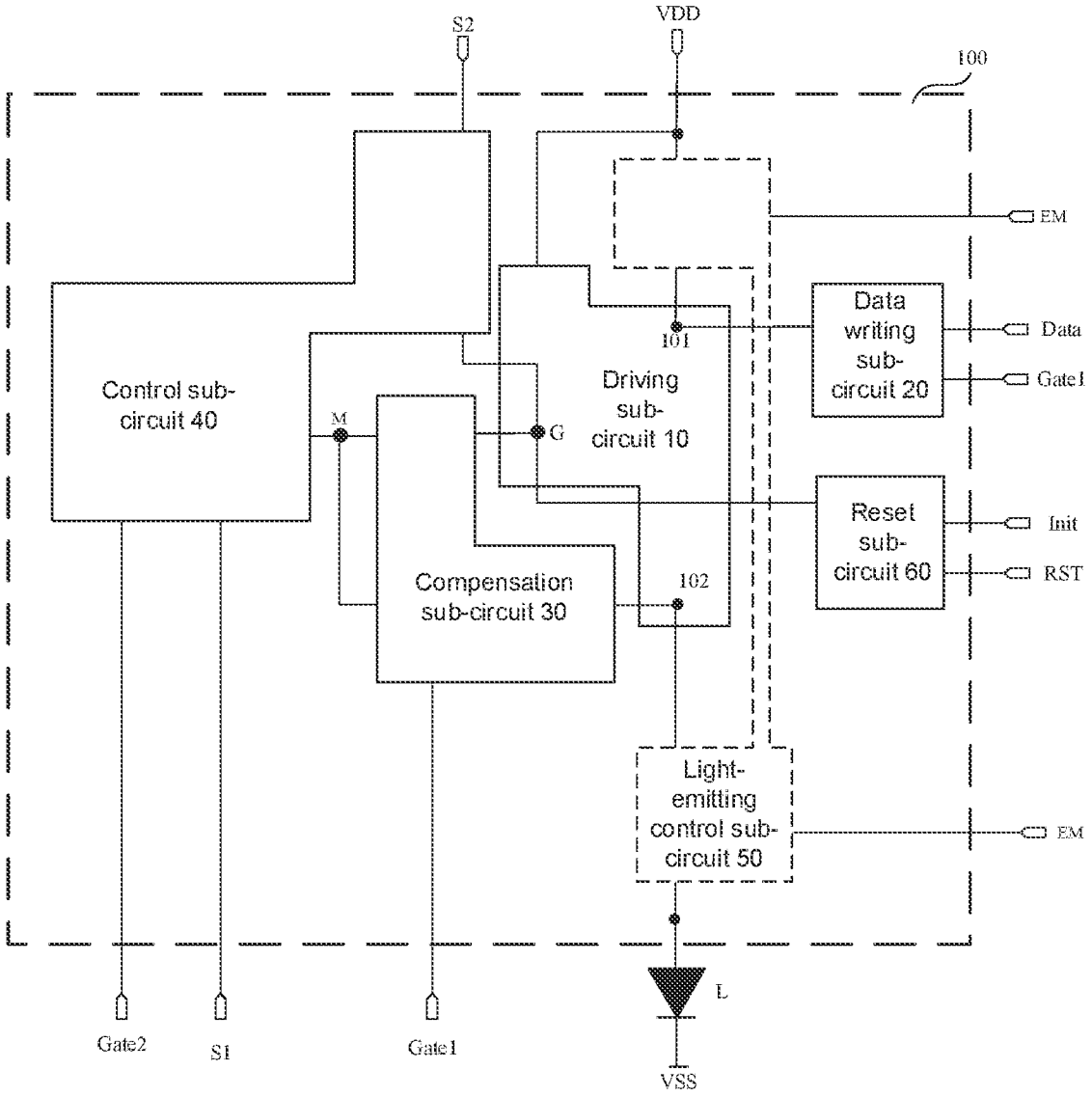
FIG. 5A is a block diagram of another light-emitting driving circuit, in accordance with some embodiments.

In some embodiments, as shown in FIG. 5A, the light-emitting driving circuit 100 further includes a reset sub-circuit 60. The reset sub-circuit 60 is coupled to the control terminal G of the driving sub-circuit 10. The reset sub-circuit 60 is configured to transmit an initialization signal to the control terminal G of the driving sub-circuit 10 in response to a reset signal, so as to reset the control terminal G of the driving sub-circuit 10.

The reset signal may be provided by a reset signal terminal RST, that is, the reset signal terminal RST is configured to transmit the reset signal. The initialization signal may be provided by an initialization signal terminal Init, that is, the initialization signal terminal Init is configured to transmit the initialization signal. In this case, the reset sub-circuit 60 is further configured to be coupled to the reset signal terminal RST and the initialization signal terminal Init.

Figure 6A:
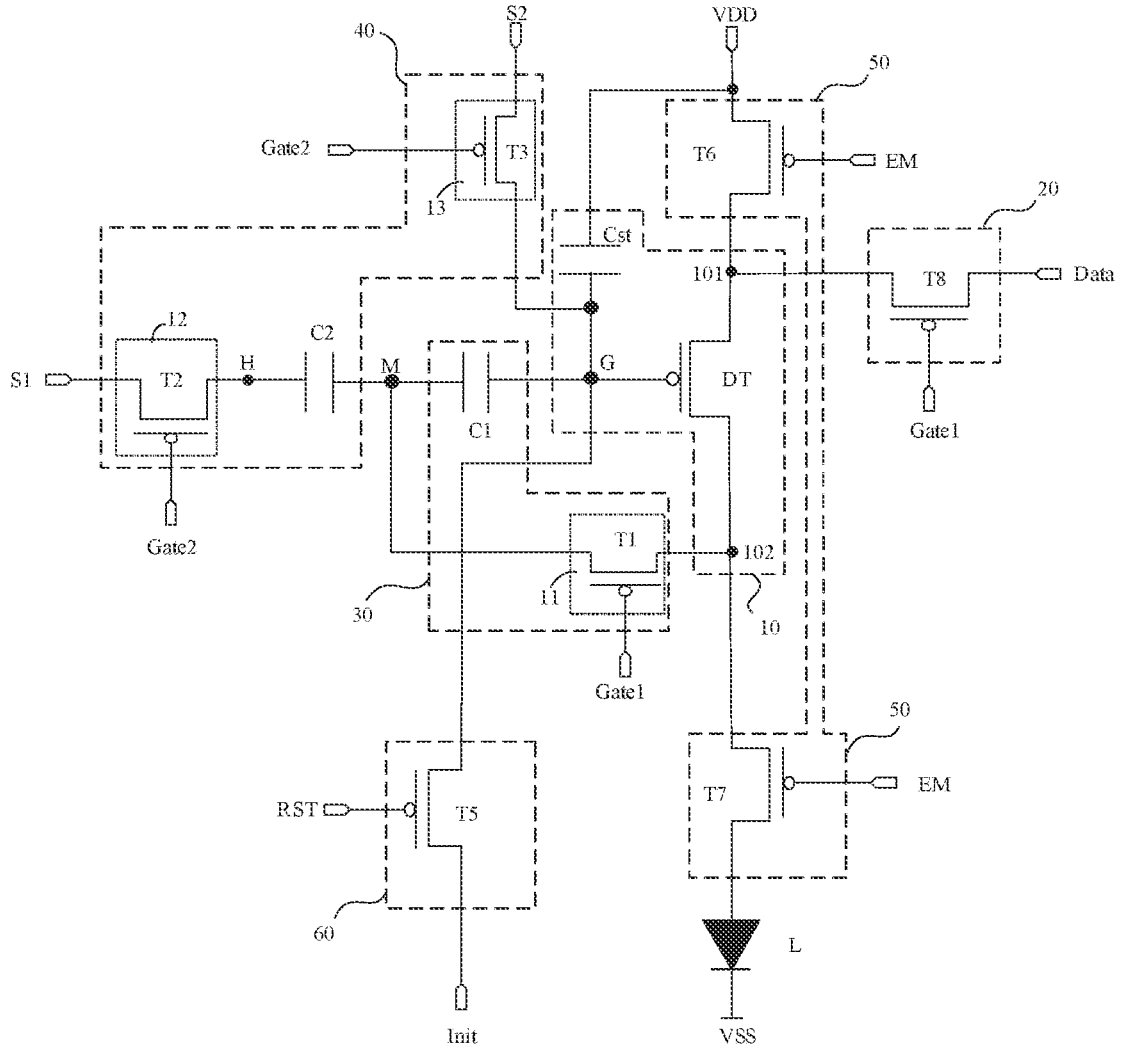
FIG. 6A is a circuit diagram of another light-emitting driving circuit, in accordance with some embodiments.

In some examples, as shown in FIG. 6A, the reset sub-circuit 60 includes a fifth transistor T5. A control electrode of the fifth transistor T5 is configured to be coupled to the reset signal terminal RST, a first electrode of the fifth transistor T5 is configured to be coupled to the initialization signal terminal Init, and a second electrode of the fifth transistor T5 is coupled to the control terminal G of the driving sub-circuit 10.

Figure 5B:
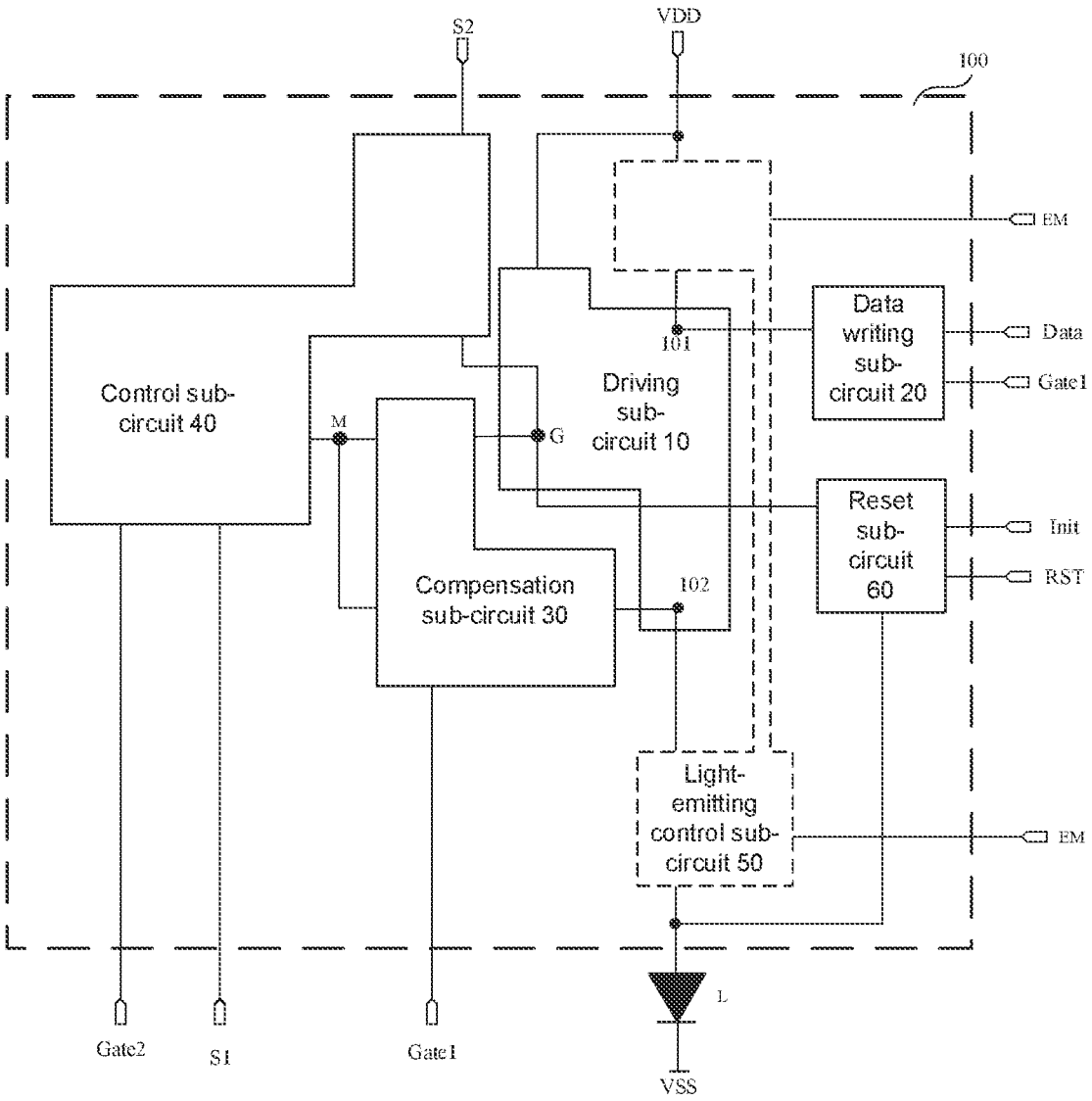
FIG. 5B is a block diagram of yet another light-emitting driving circuit, in accordance with some embodiments.

In some other embodiments, as shown in FIG. 5B, the reset sub-circuit 60 is coupled to the control terminal G of the driving sub-circuit 10, and is configured to be coupled to the light-emitting device L (e.g., the first electrode of the light-emitting device L). The reset sub-circuit 60 is further configured to: transmit the initialization signal from the initialization signal terminal Init to the control terminal G of the driving sub-circuit 10 in response to the reset signal from the reset signal terminal RST, so as to reset the control terminal G of the driving sub-circuit 10; and transmit the initialization signal to the light-emitting device L in response to the reset signal, so as to reset the light-emitting device L.

Figure 6B:
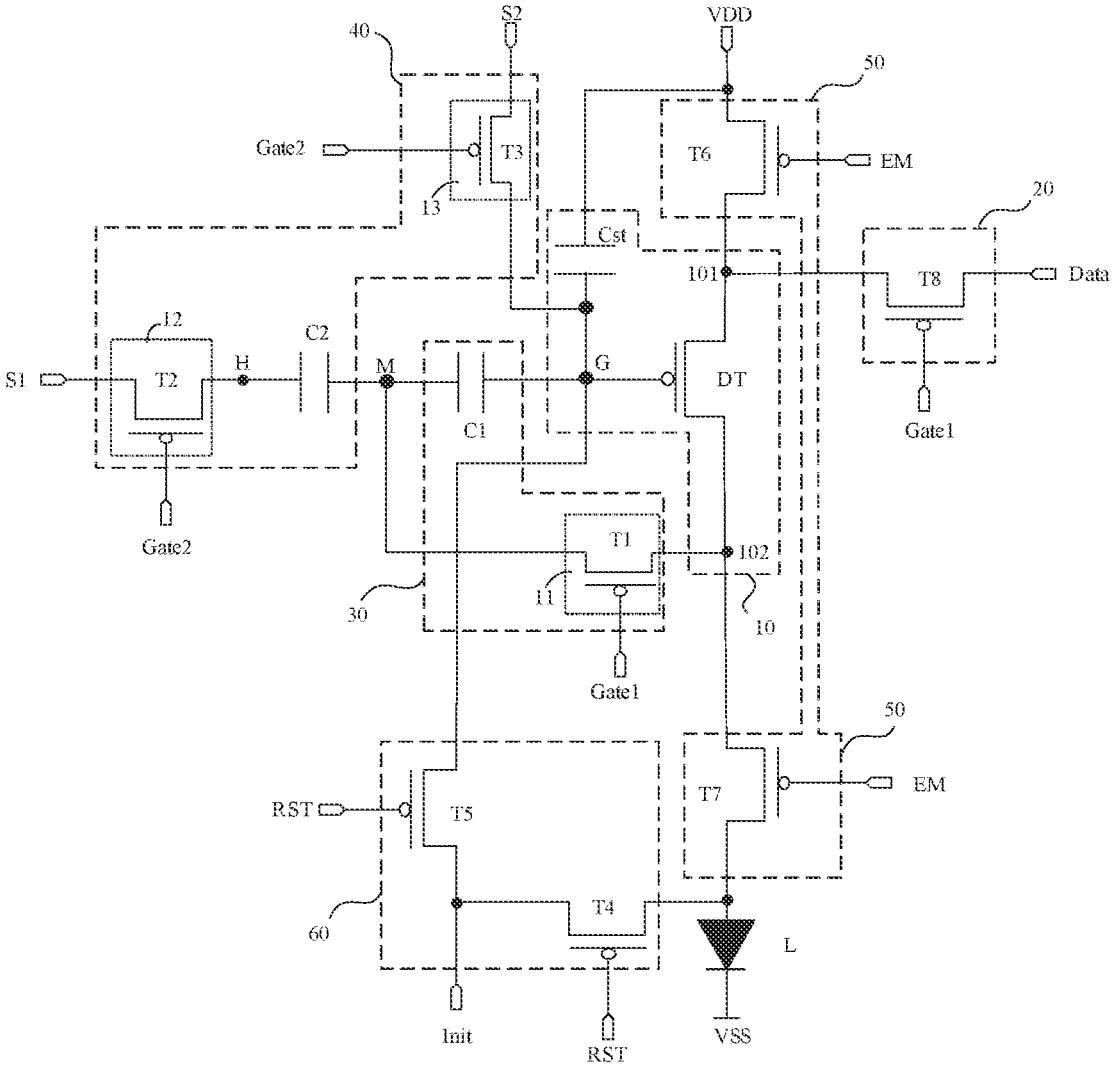
FIG. 6B is a circuit diagram of yet another light-emitting driving circuit, in accordance with some embodiments.

In some examples, as shown in FIG. 6B, the reset sub-circuit 60 includes a fourth transistor T4 and a fifth transistor T5. A control electrode of the fourth transistor T4 is configured to be coupled to the reset signal terminal RST, a first electrode of the fourth transistor T4 is configured to be coupled to the initialization signal terminal Init, and a second electrode of the fourth transistor T4 is configured to be coupled to the light-emitting device L (e.g., the first electrode of the light-emitting device L). A control electrode of the fifth transistor T5 is configured to be coupled to the reset signal terminal RST, a first electrode of the fifth transistor T5 is configured to be coupled to the initialization signal terminal Init, and a second electrode of the fifth transistor T5 is coupled to the control terminal G of the driving sub-circuit 10.

A specific structure of the light-emitting driving circuit 100 provided in the embodiments of the present disclosure will be described below. The light-emitting driving circuit 100 includes the driving sub-circuit 10, the data writing sub-circuit 20, the compensation sub-circuit 30, the control sub-circuit 40, the light-emitting control sub-circuit 50 and the reset sub-circuit 60.

As shown in FIG. 6B, the control sub-circuit 40 includes the second transistor T2, the third transistor T3 and the second capacitor C2. The control electrode of the second transistor T2 is configured to be coupled to the second scan signal terminal Gate2, the first electrode of the second transistor T2 is configured to be coupled to the first signal terminal S1, and the second electrode of the second transistor T2 is coupled to the second node H. The control electrode of the third transistor T3 is configured to be coupled to the second scan signal terminal Gate2, the first electrode of the third transistor T3 is configured to be coupled to the second signal terminal S2, and the second electrode of the third transistor T3 is coupled to the control terminal G of the driving sub-circuit 10. The second capacitor C2 is coupled between the first node M and the second node H.

The compensation sub-circuit 30 includes the first transistor T1 and the first capacitor C1. The control electrode of the first transistor T1 is configured to be coupled to the first scan signal terminal Gate1, the first electrode of the first transistor T1 is coupled to the second terminal 102 of the driving sub-circuit 10, and the second electrode of the first transistor T1 is coupled to the first node M. The first capacitor C1 is coupled between the first node M and the control terminal G of the driving sub-circuit 10.

The driving sub-circuit 10 includes the driving transistor DT and the storage capacitor Cst. The control electrode of the driving transistor DT is the control terminal G of the driving sub-circuit 10, the first electrode of the driving transistor DT is the first terminal 101 of the driving sub-circuit 10, and the second electrode of the driving transistor DT is the second terminal 102 of the driving sub-circuit 10. The first terminal of the storage capacitor Cst is coupled to the control electrode of the driving transistor DT, and the second terminal of the storage capacitor Cst is configured to be coupled to the first voltage terminal VDD for providing the first voltage.

The data writing sub-circuit 20 includes the eighth transistor T8. The control electrode of the eighth transistor T8 is configured to be coupled to the first scan signal terminal Gate1, the first electrode of the eighth transistor T8 is configured to be coupled to the data signal terminal Data, and the second electrode of the eighth transistor T8 is coupled to the first electrode of the driving transistor DT.

The light-emitting control sub-circuit 50 includes the sixth transistor T6 and the seventh transistor T7. The control electrode of the sixth transistor T6 is configured to be coupled to the light-emitting control terminal EM, the first electrode of the sixth transistor T6 is configured to be coupled to the first voltage terminal VDD, and the second electrode of the sixth transistor T6 is coupled to the first electrode of the driving transistor DT. The control electrode of the seventh transistor T7 is configured to be coupled to the light-emitting control terminal EM, the first electrode of the seventh transistor T7 is coupled to the second electrode of the driving transistor DT, and the second electrode of the seventh transistor T7 is configured to be coupled to the first electrode of the light-emitting device L. The second electrode of the light-emitting device L is coupled to the second voltage terminal VSS.

The reset sub-circuit 60 includes the fourth transistor T4 and the fifth transistor T5. The control electrode of the fourth transistor T4 is configured to be coupled to the reset signal terminal RST, the first electrode of the fourth transistor T4 is configured to be coupled to the initialization signal terminal Init, and the second electrode of the fourth transistor T4 is configured to be coupled to the first electrode of the light-emitting device L. The control electrode of the fifth transistor T5 is configured to be coupled to the reset signal terminal RST, the first electrode of the fifth transistor T5 is configured to be coupled to the initialization signal terminal Init, and the second electrode of the fifth transistor T5 is coupled to the control terminal G of the driving sub-circuit 10.

It will be noted that transistors used in the light-emitting driving circuit provided in the embodiments of the present disclosure may be thin film transistors, field effect transistors, or other switching devices with like characteristics. The embodiments of the present disclosure are described by taking an example where the transistors are thin film transistors.

In some embodiments, a control electrode of each transistor used in the light-emitting driving circuit is a gate of the transistor, a first electrode of each transistor is one of a source and a drain of the transistor, and a second electrode of each transistor is another one of the source and the drain of the transistor. Since the source and the drain of the transistor may be symmetrical in structure, there may be no difference in structure between the source and the drain of the transistor. That is to say, there may be no difference in structure between the first electrode and the second electrode of the transistor in the embodiments of the present disclosure. In a case where the transistor is a P-type transistor, the first electrode of the transistor is the source, and the second electrode thereof is the drain. In a case where the transistor is an N-type transistor, the first electrode of the transistor is the drain, and the second electrode thereof is the source.

In the embodiments of the present disclosure, each of terminals (e.g., the first scan signal terminal Gate1, the second scan signal terminal Gate2, the data signal terminal Data, the first signal terminal S1, the second signal terminal S2, the reset signal terminal RST, the light-emitting control signal terminal EM, the initialization signal terminal Init, the first voltage terminal VDD and the second voltage terminal VSS) is a connection point in the circuit. The terminal may be a node of a relevant electrical connection in the circuit diagram, that is, the terminal is equivalent to the node of the relevant connection in the circuit diagram.

In the circuit provided in the embodiments of the present disclosure, the first node M and the second node H do not represent actual components, but represent junction points of relevant electrical connections in the circuit diagram, that is, these nodes are equivalent to the junction points of the relevant electrical connections in the circuit diagram.

In the embodiments of the present disclosure, specific implementation manners of the driving sub-circuit 10, the data writing sub-circuit 20, the compensation sub-circuit 30, the control sub-circuit 40, the light-emitting control sub-circuit 50 and the reset sub-circuit 60 are not limited to the manners described above, and may be any implementation manner, as long as the realization of corresponding functions may be guaranteed. The above embodiments/examples do not limit the protection scope of the present disclosure. In practical applications, a person skilled in the art may choose to use or not to use one or more of the above sub-circuits according to situations. Various combinations and variations based on the above sub-circuits do not depart from the principle of the present disclosure, and details are not repeated here.

An operation process of the light-emitting driving circuit 100 in the embodiments of the present disclosure will be described below.

Figure 7:
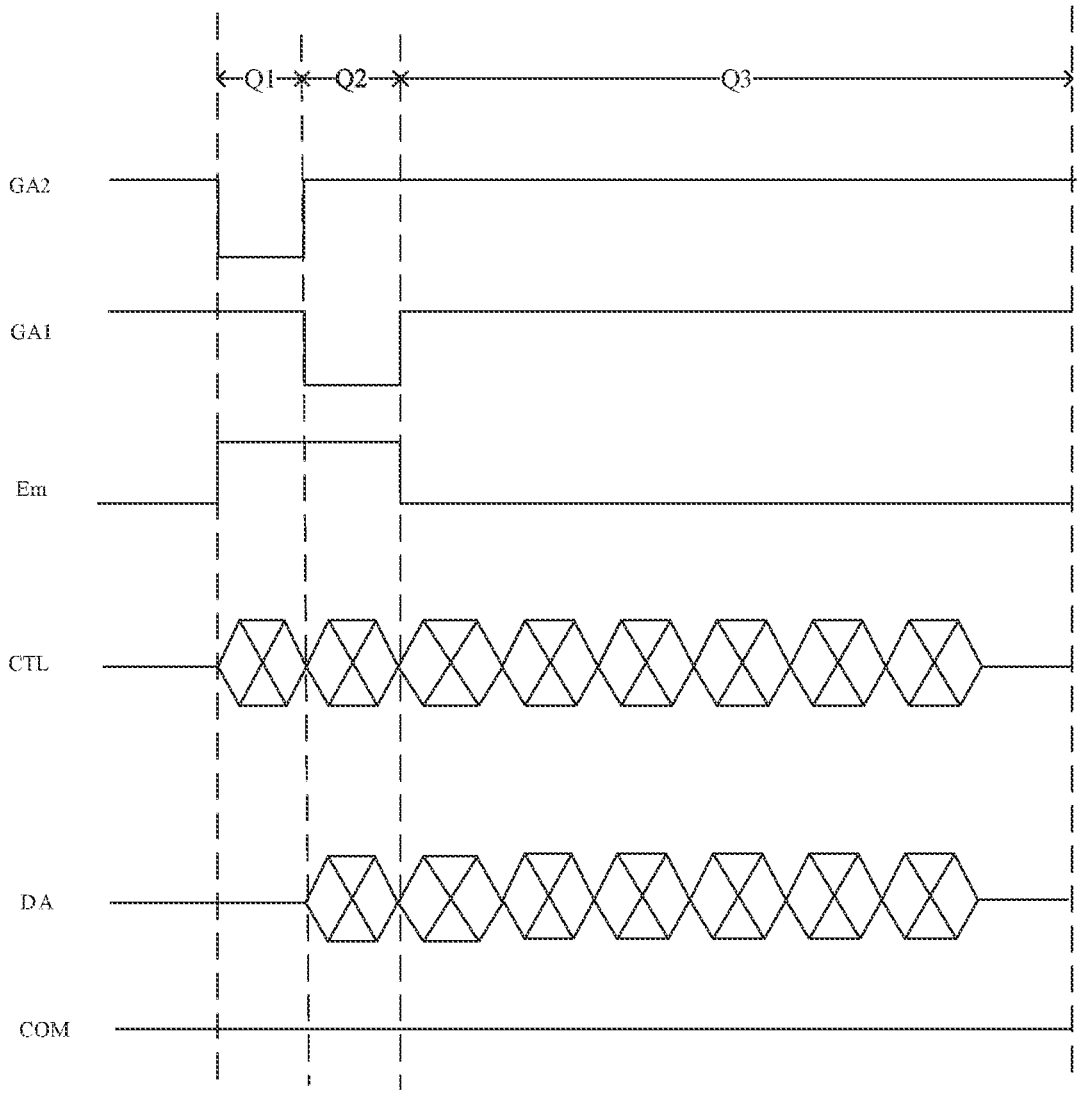
FIG. 7 is a timing diagram of a light-emitting driving circuit, in accordance with some embodiments.

In some examples, referring to FIG. 7, an operation period of the light-emitting driving circuit 100 includes a first period Q1, a second period Q2 and a third period Q3. For example, referring to FIGS. 4, 6A and 6B, all transistors in the light-emitting driving circuit 100 are P-type transistors. In this case, all transistors in the light-emitting driving circuit 100 are turned on in response to a low-level signal and are turned off in response to a high-level signal.

In the first period Q1 in FIG. 7, referring to FIGS. 2, 5A and 5B, the control sub-circuit 40 initializes the voltage of the first node M and the voltage of the control terminal G of the driving sub-circuit 10 in response to the second scan signal GA2 (e.g., a low-level voltage of the second scan signal GA2) from the second scan signal terminal Gate2.

Figure 8A:
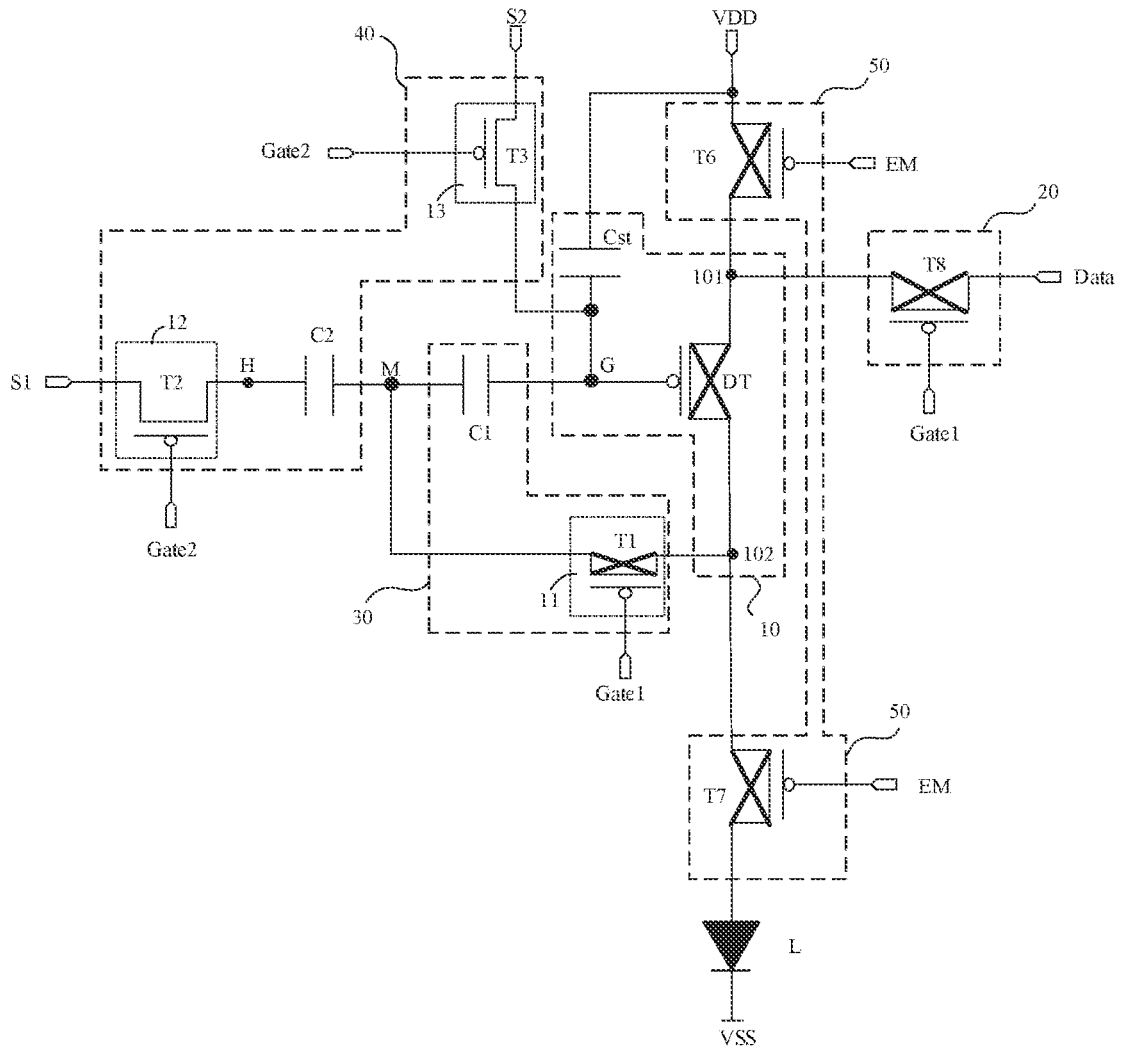
FIGS. 8A to 8C are diagrams showing a driving process of a light-emitting driving circuit, in accordance with some embodiments.

For example, as shown in FIG. 8A, the second transistor T2 in the control sub-circuit 40 is turned on in response to the low-level voltage of the second scan signal GA2, and transmits a first signal CTL from the first signal terminal S1 to the second node H. The third transistor T3 in the control sub-circuit 40 is turned on in response to the low-level voltage of the second scan signal GA2, and transmits a second signal COM from the second signal terminal S2 to the control terminal G of the driving sub-circuit 10, i.e., the control electrode of the driving transistor DT.

In this case, a voltage of the second terminal (i.e., the terminal coupled to the control terminal G of the driving sub-circuit 10) of the first capacitor C1 in the compensation sub-circuit 30 is the voltage $V_G$ of the control terminal G of the driving sub-circuit 10, i.e., a voltage $V_{COM}$ of the second signal COM. The first terminal of the second capacitor C2 is coupled to the second node H, and thus the voltage $V_H$ of the first terminal of the second capacitor C2 is a voltage $V_{CTL}$ of the first signal CTL. Since the second terminal of the second capacitor C2 and the first terminal of the first capacitor C1 are both connected to the first node M, the first capacitor C1 and the second capacitor C2 are connected in series, and the first node M is the connection point of the series structure. Therefore, a voltage $V_1$ on the first capacitor C1 is obtained by a formula $$V_1 = V_M - V_G = \frac{CA1}{CA1 + CA2} \times V.$$

V is a voltage applied to the series structure, and V is equal to a difference of $V_H$ and $V_G$ (i.e., $V=V_H-V_G=V_{CTL}-V_{COM}$). $V_G$ is equal to $V_{COM}$ ($V_G=V_{COM}$). A voltage $V_M$ of the first node M is obtained by a formula $$V_M = \frac{1}{z+1}(V_{CTL} + z \times V_{COM}),$$

where z is equal to $$\frac{CA2}{CA1},$$

CA1 represents a capacitance of the first capacitor C1, and CA2 represents a capacitance of the second capacitor C2.

In some examples, a value of z is in a range from 1 to 10, such as 1, 2, 4, 5, 8 or 10. The capacitance CA1 of the first capacitor C1 may be in a range from 0.1 pF to 10.1 pF, such as 0.1 pF, 0.5 pF, 1.5 pF, 2 pF, 3 pF, 5 pF, or 10.1 pF. The capacitance CA2 of the second capacitor C2 may be in a range from 0.1 pF to 10.1 pF, such as 0.1 pF, 0.5 pF, 1.5 pF, 2 pF, 3 pF, 5 pF or 10.1 pF.

In some examples, the second signal COM is a direct current voltage signal, such as a low-level direct current voltage signal. For example, the voltage $V_{COM}$ of the second signal COM is 0, and the voltage $V_M$ of the first node M is $$\frac{1}{z+1} V_{CTL}.$$

In addition, in the first period Q1, as shown in FIG. 8A, the first transistor T1 in the compensation sub-circuit 30, the eighth transistor T8 in the data writing sub-circuit 20, the driving transistor DT in the driving sub-circuit 10, and the sixth transistor T6 and the seventh transistor T7 in the light-emitting control sub-circuit 50 are all in an off state.

Therefore, in the first period Q1, the initialized voltage of the first node M is $$\frac{1}{z+1}(V_{CTL}+z\times V_{COM}).$$

A voltage difference between the two terminals of the first capacitor C1 is a difference between the initialized voltage of the first node M and the initialized voltage of the control terminal G of the driving sub-circuit 10, i.e., $$\frac{1}{z+1}(V_{CTL}+z\times V_{COM})-V_{COM}.$$

In the second period Q2 in FIG. 7, as shown in FIGS. 2, 5A and 5B, the data writing sub-circuit 20 writes the data signal DA from the data signal terminal Data into the first terminal 101 of the driving sub-circuit 10 in response to the first scan signal GA1 (e.g., a low-level voltage of the first scan signal GA1) from the first scan signal terminal Gate1. The second terminal 102 of the driving sub-circuit 10 outputs the data signal DA and the compensation signal. The compensation sub-circuit 30 transmits the data signal DA and the compensation signal to the first node M in response to the first scan signal GA1.

Figure 8B:
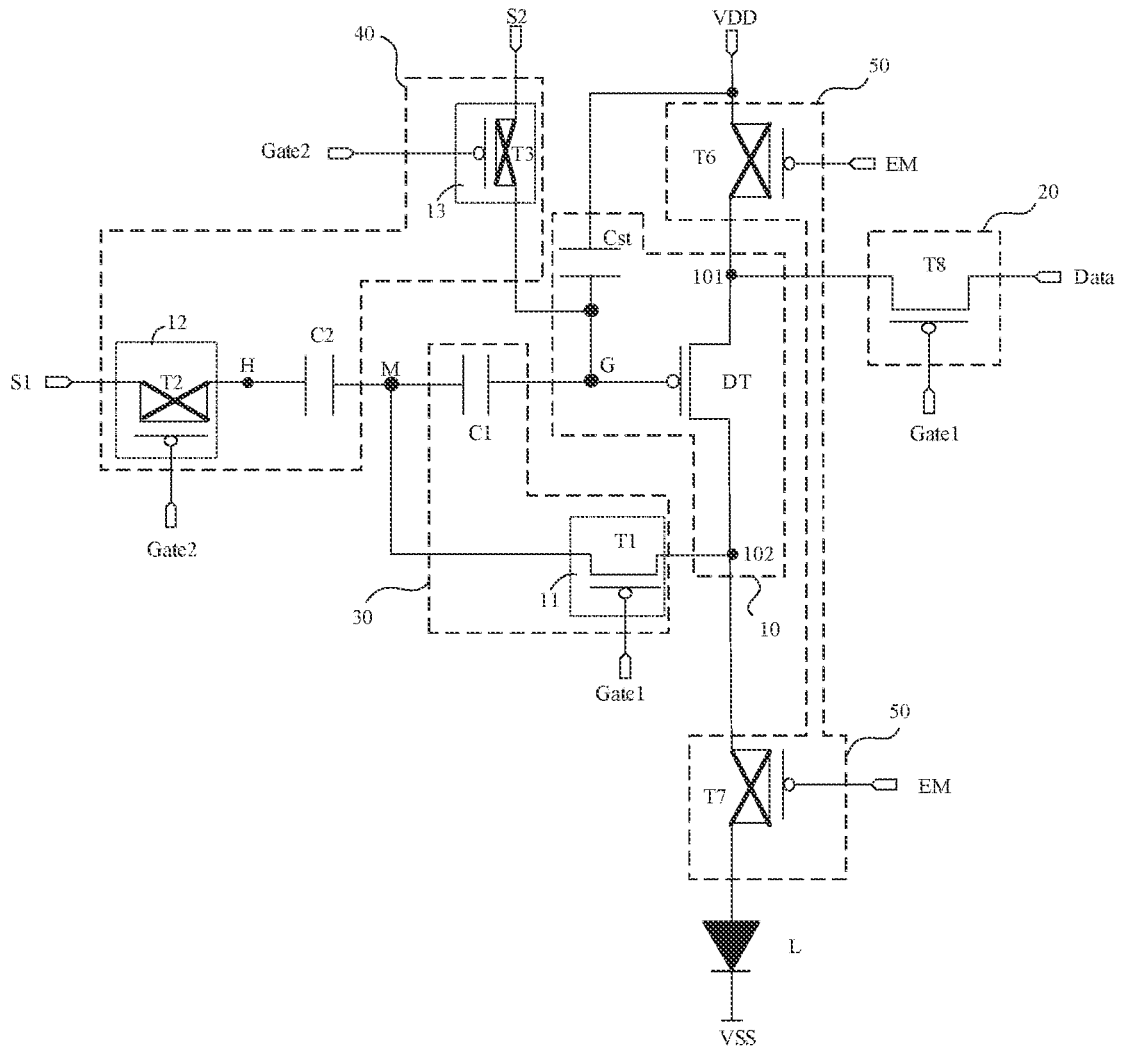

For example, as shown in FIG. 8B, the eighth transistor T8 is turned on in response to the low-level voltage of the first scan signal GA1, and writes the data signal DA into the first electrode of the driving transistor DT. The driving transistor DT outputs, from the second electrode of the driving transistor DT, the data signal DA written into the first electrode of the driving transistor DT and the threshold voltage of the driving transistor DT. The first transistor T1 is turned on in response to the low-level voltage of the first scan signal GA1, and transmits the data signal DA and the threshold voltage of the driving transistor DT to the first node M. In this case, the voltage $V'_M$ of the first node M is a sum of a voltage $V_{data}$ of the data signal DA and the threshold voltage $V_{th}$ of the driving transistor DT ($V'_M=V_{data}+V_{th}$). The compensation signal is the threshold voltage $V_{th}$ of the driving transistor DT.

Due to a coupling effect of the first capacitor C1, the voltage difference of the two terminals of the first capacitor C1 is kept at the voltage difference thereof in a previous period (i.e., the first period Q1). That is, in the second period Q2, the voltage difference of the two terminals of the first capacitor C1 is $$\frac{1}{z+1}(V_{CTL}+z\times V_{COM})-V_{COM}.$$

Since the voltage $V'_M$ of the first node M becomes $V_{data}+V_{th}$, the voltage $V'_G$ of the control terminal G of the driving sub-circuit 10 becomes $$V_{data}+V_{th}+V_{COM}-\frac{1}{z+1}(V_{CTL}+z\times V_{COM}).$$

In addition, in the second period Q2, as shown in FIG. 8B, the second transistor T2 and the third transistor T3 in the control sub-circuit 40, and the sixth transistor T6 and the seventh transistor T7 in the light-emitting control sub-circuit 50 are in an off state.

In the third period Q3 in FIG. 7, as shown in FIGS. 2, 5A and 5B, the light-emitting control sub-circuit 50 transmits the first voltage from the first voltage terminal VDD to the first terminal 101 of the driving sub-circuit 10 in response to the light-emitting control signal Em (e.g., a low-level voltage of the light-emitting control signal Em) from the light-emitting control terminal EM. The driving sub-circuit 10 outputs the driving signal according to the first voltage $V_{dd}$ and the voltage $V'_G$ of the control terminal G, so as to drive the light-emitting device L to emit light.

Figure 8C:
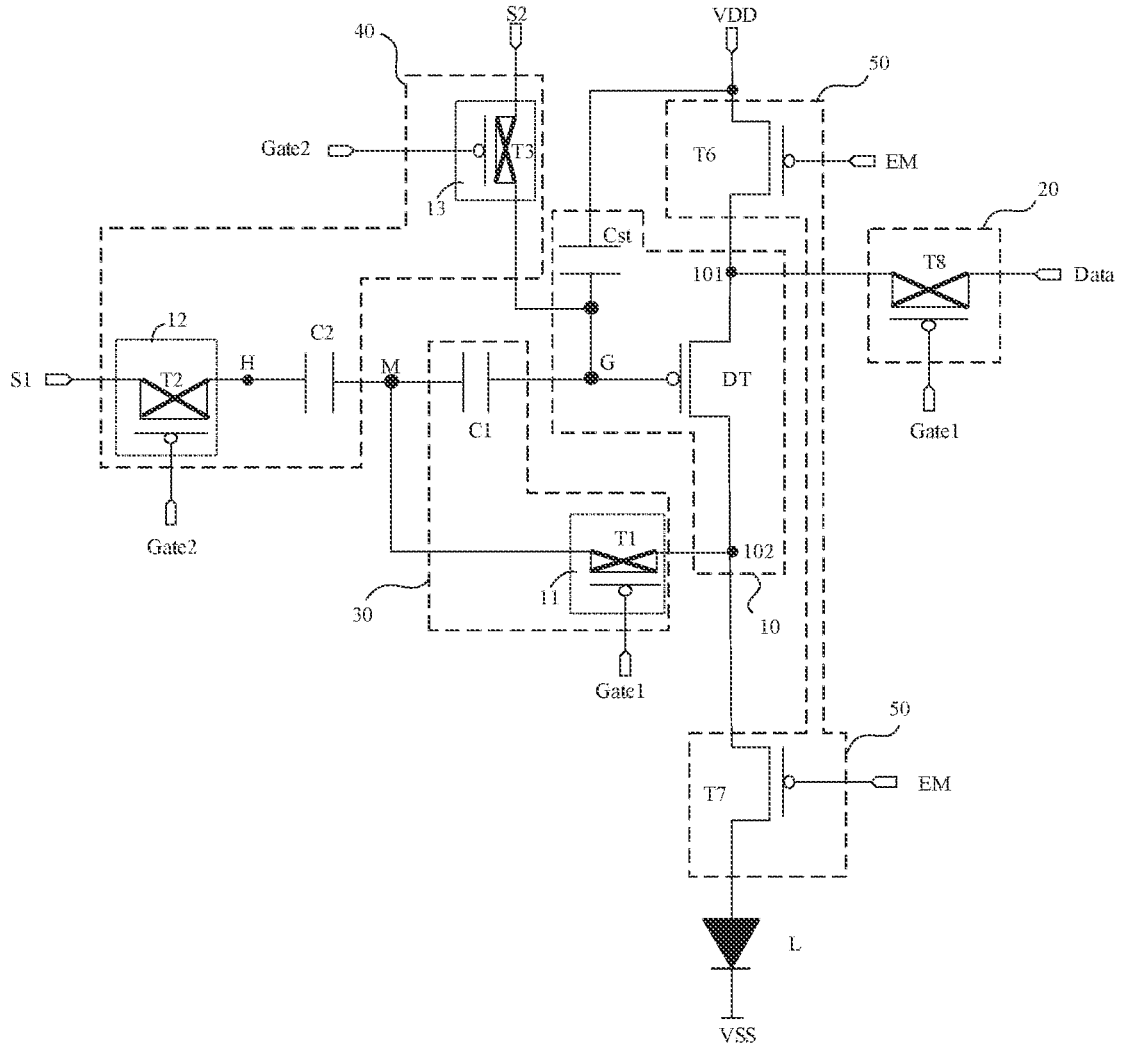

For example, as shown in FIG. 8C, the sixth transistor T6 in the light-emitting control sub-circuit 50 is turned on in response to the low-level voltage of the light-emitting control signal Em, and transmits a first voltage $V_{dd}$ to the first terminal 101 of the driving sub-circuit 10 (i.e., the first electrode of the driving transistor DT). The driving transistor DT outputs the driving signal according to the voltage $V'_G$ of the control terminal G of the driving sub-circuit 10 (i.e., the control electrode of the driving transistor DT) and the first voltage $V_{dd}$. The seventh transistor T7 is turned on in response to the low-level voltage of the light-emitting control signal Em, and transmits the driving signal to the light-emitting device L, so that the light-emitting device L emits light according to the driving signal.

In addition, in the third period Q3, referring to FIG. 8C, the eighth transistor T8 in the data writing sub-circuit 20, the second transistor T2 and the third transistor T3 in the control sub-circuit 40, and the first transistors T1 in the compensation sub-circuit 30 are all in an off state.

It will be noted that the driving signal for driving the light-emitting device L to emit light may be a driving current or a driving voltage, which is not limited here.

For example, the driving signal is a driving current. The driving current I is obtained by a formula $I=K\times(V_{gs}-V_{th})^2$, where $$K=\frac{1}{2}\times\mu\times Cox\times\frac{W}{L},\ \mu$$

is a channel carrier mobility, Cox is a dielectric constant of a channel insulating layer, $$\frac{W}{L}$$

is a width-to-length ratio of a channel of the driving transistor DT, and $V_{gs}$ is a gate-source voltage difference of the driving transistor DT (that is, $V_{gs}$ is a voltage difference between the control electrode and the first electrode of the driving transistor DT). A voltage of the gate of the driving transistor DT is the voltage $V'_G$ of the control terminal G of the driving sub-circuit 10, which is equal to $$V_{data}+V_{th}+V_{COM}-\frac{1}{z+1}(V_{CTL}+z\times V_{COM}),$$

and a voltage of the first electrode of the driving transistor DT is the first voltage $V_{dd}$. Therefore, the driving current I is equal to $$K\times\left(V_{data}+V_{th}+V_{COM}-\frac{1}{z+1}(V_{CTL}+z\times V_{COM})-V_{dd}-V_{th}\right)^2,$$

and is further equal to $$K\times\left(V_{data}+V_{COM}-\frac{1}{z+1}(V_{CTL}+z\times V_{COM})-V_{dd}\right)^2.$$

It can be seen that the driving current I is unrelated to the threshold voltage $V_{th}$ of the driving transistor DT. Therefore, it is possible to avoid influence of the threshold voltage on the driving current output by the driving sub-circuit 10, thereby ensuring accuracy of the displayed gray scale.

For example, capacitances of the first capacitor C1 and the second capacitor C2 are equal, i.e., z is 1; the voltage of the second signal is zero, i.e., $V_{COM}$ is 0 V; and the voltage of the first signal is equal to the voltage of the data signal, i.e., $V_{CTL}$ is equal to $V_{data}$. Based on this, the driving current I is equal to $$K\times\left(\frac{1}{2}V_{data}-V_{dd}\right)^2,$$

which is equivalent that a magnitude of the data voltage is changed into half of the magnitude of the data voltage written into the first terminal 101 of the driving sub-circuit 10, i.e., is changed from $V_{data}$ to ½$V_{data}$, thereby reducing the magnitude of the driving current.

Therefore, for the light-emitting driving circuit 100 provided in the embodiments of the present disclosure, by adjusting the capacitances of the first capacitor C1 and the second capacitor C2, the voltage of the first signal and the voltage of the second signal, a smaller driving signal is obtained. Based on this, when a low gray scale is displayed, the data voltage may be divided more finely, thereby improving the accuracy of gray scale display. As a result, the gray scale and the brightness is more in line with the Gamma curve.

In some examples, the capacitances of the first capacitor C1 and the second capacitor C2 are not equal, i.e., z is not equal to 1; and the voltage of the second signal is zero, i.e., $V_{COM}$ is 0 V. Based on this, if a relationship between the voltage $V_{CTL}$ of the first signal and the data voltage $V_{data}$ meets a formula $$V_{CTL}=\frac{z+1}{2}V_{data},$$

the magnitude of the data voltage is changed into half of the magnitude of the data voltage written into the first terminal 101 of the driving sub-circuit 10, i.e., is changed from $V_{data}$ to ½$V_{data}$. In this way, by adjusting the voltage of the first signal, the data voltage may be divided more finely to obtain a smaller driving signal when displaying the low gray scale.

The value of z determines a value of the voltage $V_{CTL}$ of the first signal CTL. The value of z may be determined according to the capacitances of the first capacitor C1 and the second capacitor C2 during actual design and fabrication, so as to determine the value of the voltage $V_{CTL}$ of the first signal.

It will be noted that various parameters related to the light-emitting driving circuit 100, such as the first signal, the second signal, and the capacitances of the first capacitor C1 and the second capacitor C2 may be adjusted according to actual conditions, so as to meet the condition of using the light-emitting driving circuit 100 provided in the embodiments of the present disclosure to implement data voltage division, which is not limited herein.

Figure 9:
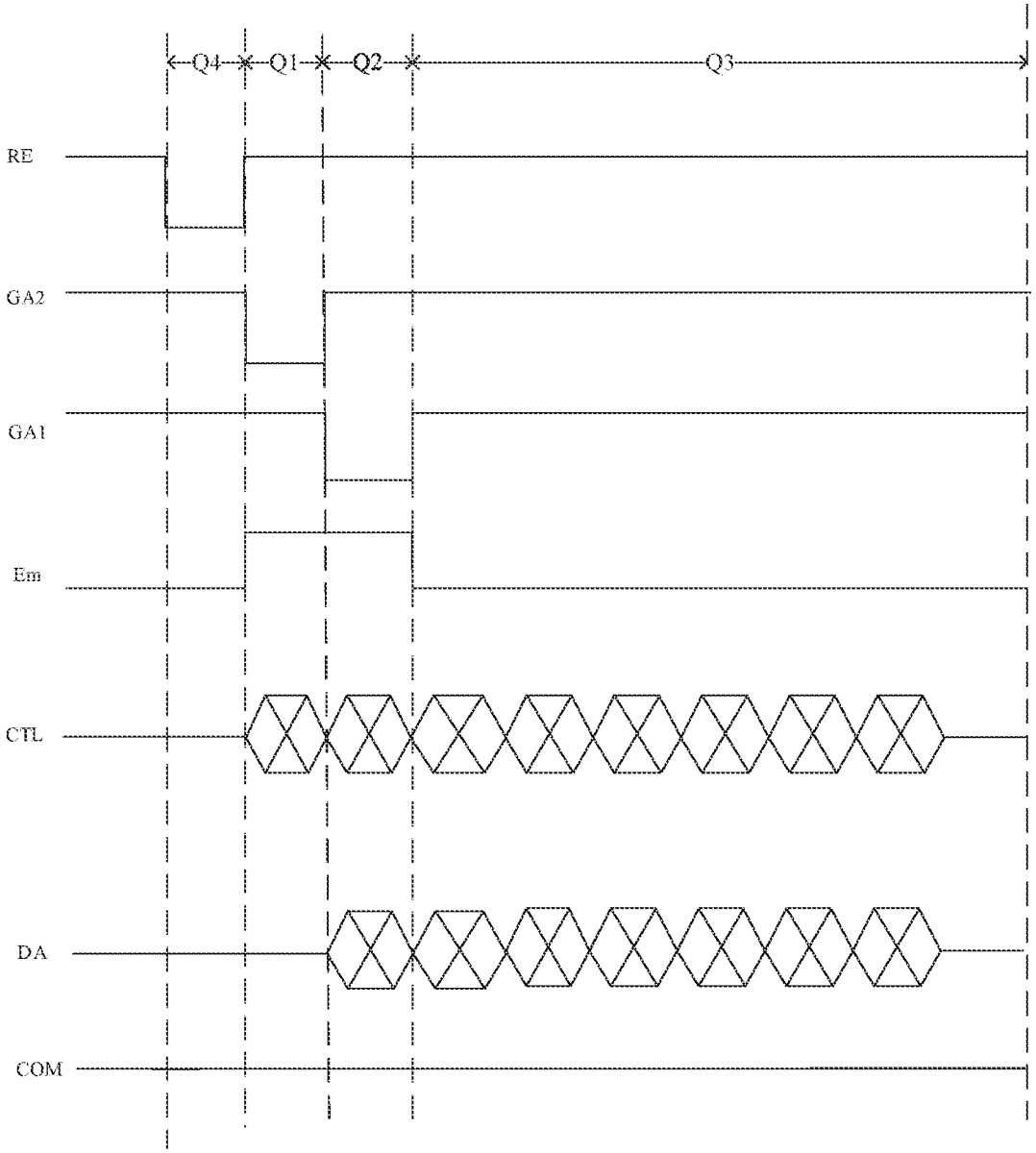
FIG. 9 is a timing diagram of another light-emitting driving circuit, in accordance with some embodiments.

In some embodiments, the light-emitting driving circuit 100 further includes the reset sub-circuit 60, and referring to FIG. 9, the operation period of the light-emitting driving circuit 100 further includes a fourth period Q4 before the first period Q1.

In the fourth period Q4, as shown in FIG. 5A, the reset sub-circuit 60 transmits the initialization signal from the initialization signal terminal Init to the control terminal G of the driving sub-circuit 10 in response to the reset signal RE (e.g., a low-level voltage of the reset signal RE) from the reset signal terminal RST, so as to reset the control terminal G of the driving sub-circuit 10.

In the fourth period Q4, as shown in FIG. 5B, the reset sub-circuit 60 also transmits the initialization signal to the light-emitting device L in response to the reset signal RE, so as to reset the light-emitting device L.

Figure 10:
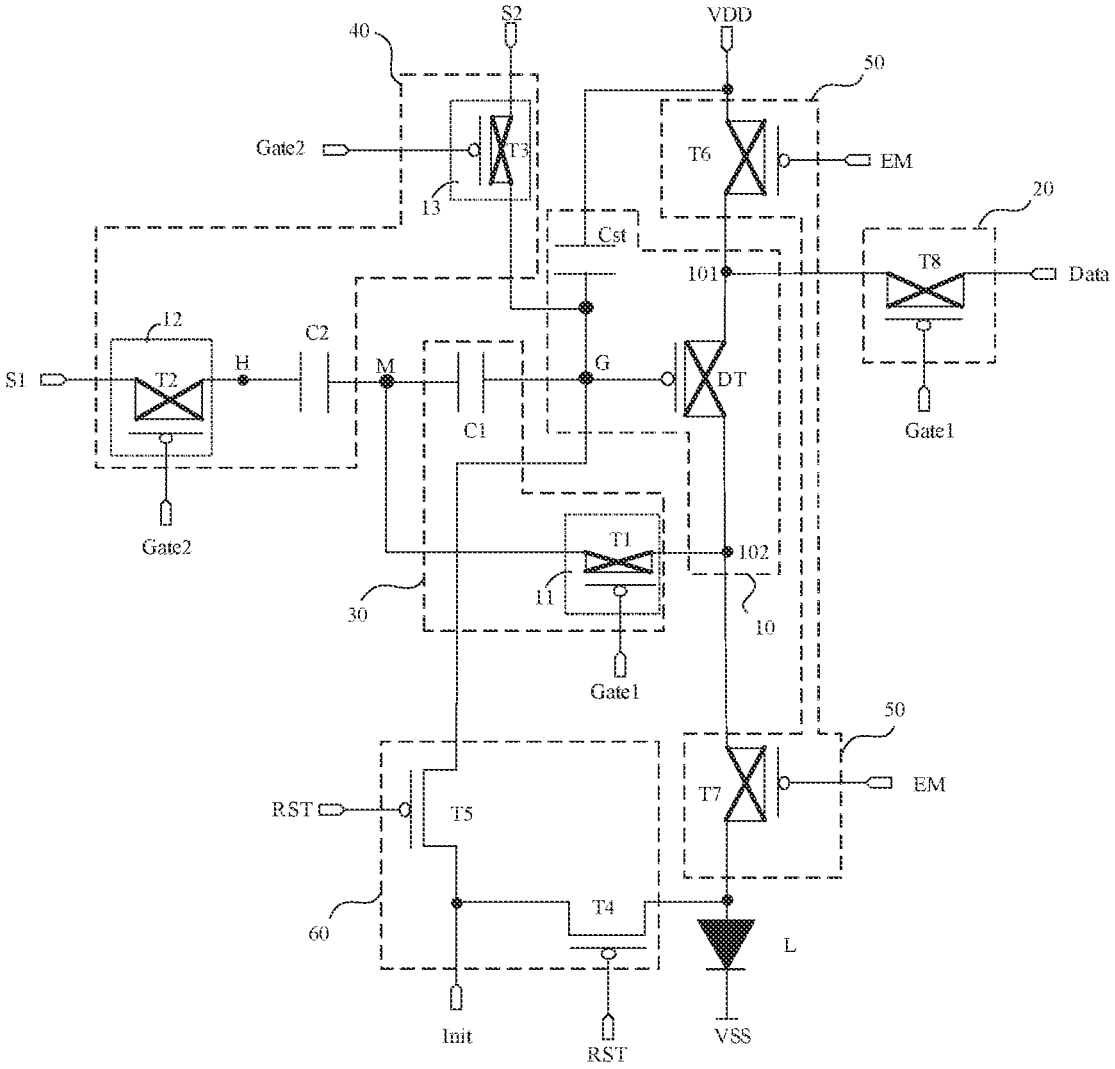
FIG. 10 is a diagram showing a driving process of another light-emitting driving circuit, in accordance with some embodiments.

For example, as shown in FIG. 10, the fifth transistor T5 in the reset sub-circuit 60 is turned on in response to the low-level voltage of the reset signal RE, and transmits the initialization signal to the control terminal G of the driving sub-circuit 10 (i.e., the control electrode of the driving transistor DT), so as to reset the control electrode of the driving transistor DT. As shown in FIG. 10, the fourth transistor T4 in the reset sub-circuit 60 is turned on in response to the low-level voltage of the reset signal RE, and transmits the initialization signal to the light-emitting device L (e.g., the first electrode of the light-emitting device L), so as to reset the light-emitting device L. In this way, it is possible to reduce an influence of a residual signal in a previous frame on a current frame, so as to ensure the accuracy of displaying the current frame.

In addition, referring FIG. 10, in the fourth period Q4, the driving transistor DT in the driving sub-circuit 10, the eighth transistor T8 in the data writing sub-circuit 20, the first transistor T1 in the compensation sub-circuit 30, the second transistor T2 and the third transistor T3 in the control sub-circuit 40, and the sixth transistor T6 and the seventh transistor T7 in the light-emitting control sub-circuit 50 are all in an off state.

Referring to FIGS. 6B and 9, in the first period Q1, the second period Q2 and the third period Q3, a voltage of the reset signal RE is a high-level voltage, and the four transistor T4 and the fifth transistor T5 in the reset sub-circuit 60 are in an off state.

In some embodiments, in a process of manufacturing the light-emitting apparatus 2, a metal pattern in the same layer as a certain electrode of the transistor may be utilized to serve as an electrode of the capacitor, and the electrode of the capacitor does not need to be separately manufactured, so that the existing conductive layer is utilized to the maximum extent, the space is saved, and the process is simplified.

Figure 11:
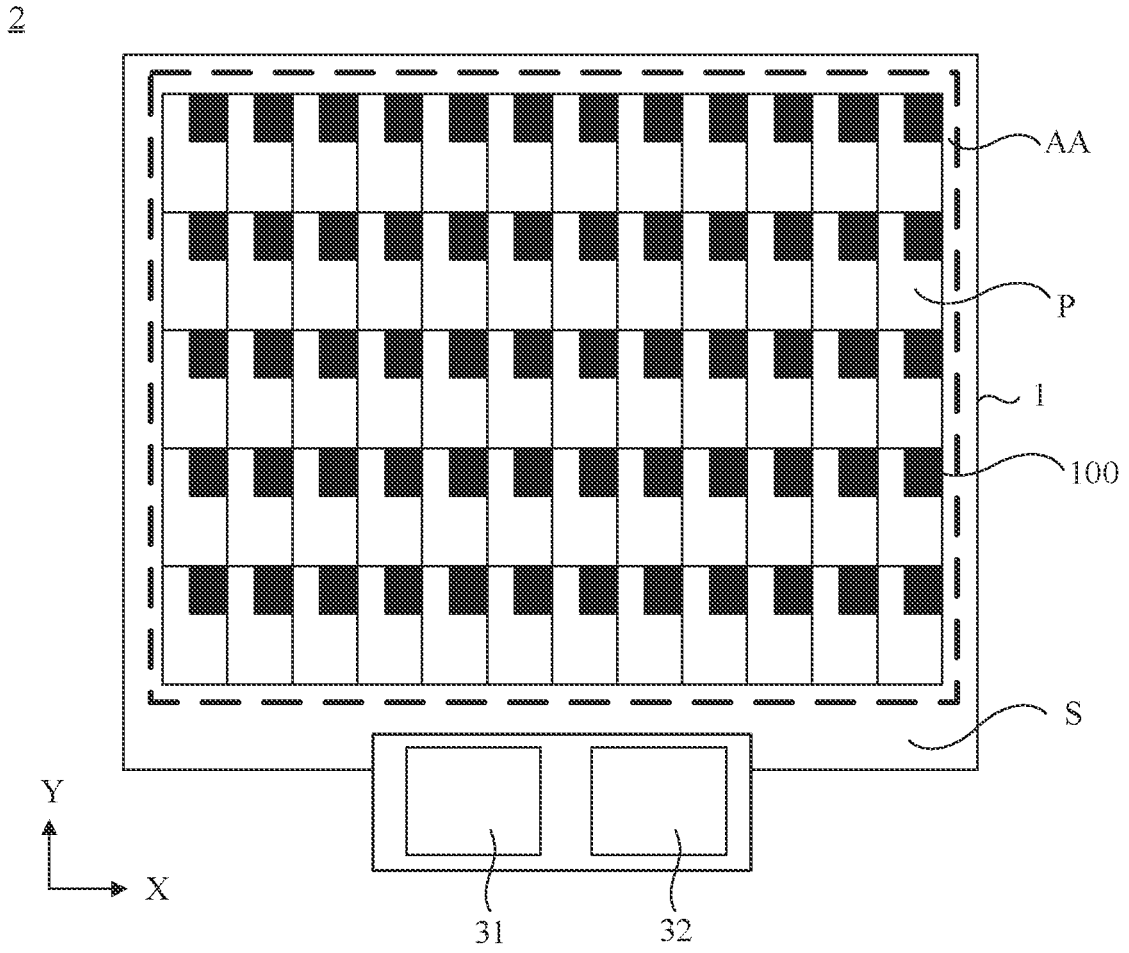
FIG. 11 is a structural diagram of a light-emitting apparatus, in accordance with some embodiments.
Figure 12:
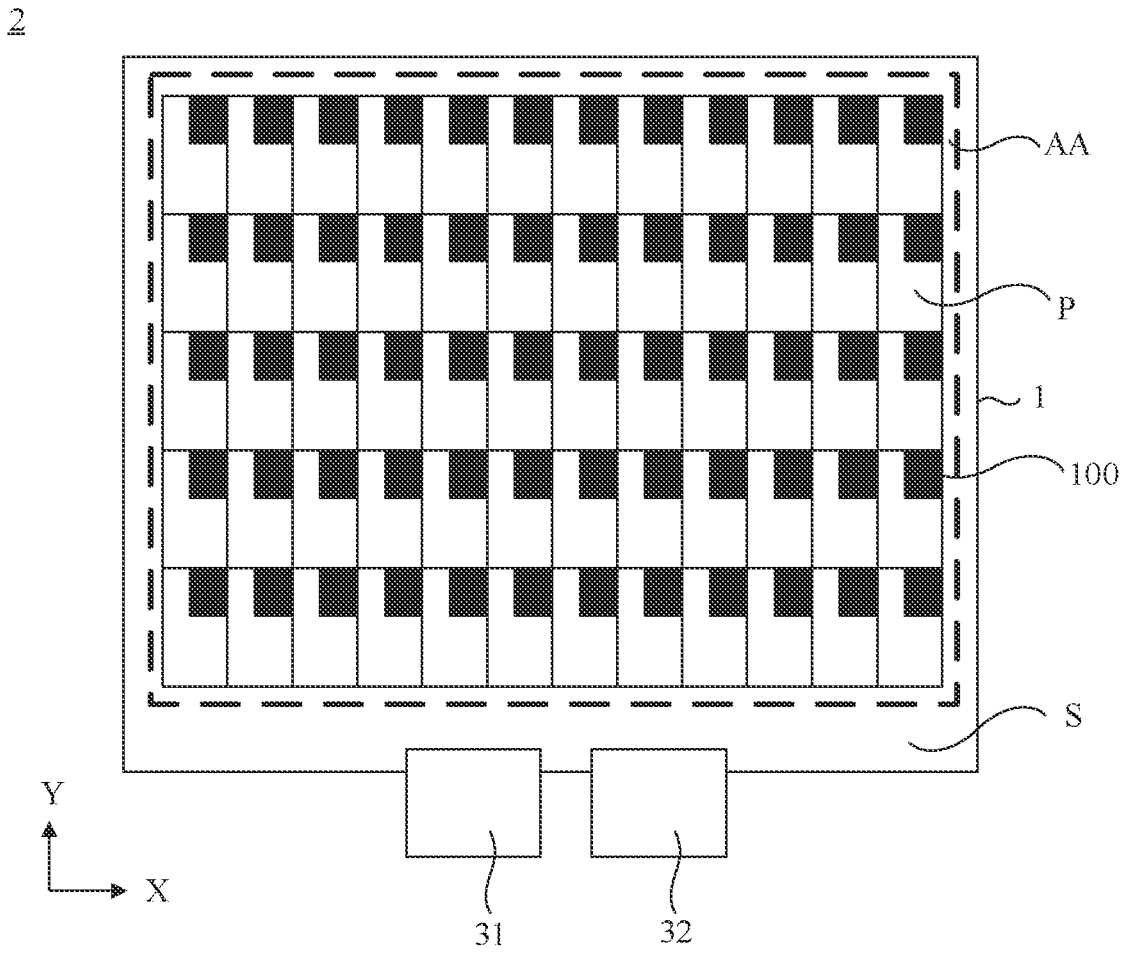
FIG. 12 is a structural diagram of another light-emitting apparatus, in accordance with some embodiments.

In some embodiments, the light-emitting apparatus is a display apparatus. As shown in FIGS. 11 and 12, the display apparatus 2 includes a display panel 1. The display panel 1 has a display area AA and a peripheral area S, and the peripheral area S is located on at least one side of the display area AA. The display panel 1 includes a plurality of sub-pixels P located in the display area AA. As shown in FIG. 1, each of at least one sub-pixel P (e.g., each of the plurality of sub-pixel P) includes one light-emitting driving circuit 100 and one light-emitting device L coupled thereto. The light-emitting driving circuit 100 is used as a pixel driving circuit.

The embodiments of the present disclosure do not limit a specific arrangement of the plurality of sub-pixels P, which may be designed according to actual needs. For example, the plurality of sub-pixels P is arranged in a matrix. In this case, as shown in FIGS. 1, 11, 12 and 13, sub-pixels P arranged in a line in a first direction X are referred to as a row of sub-pixels, and sub-pixels P arranged in a line in a second direction Y are referred to as a column of sub-pixels. The first direction X crosses the second direction Y. For example, the first direction X is perpendicular to the second direction Y.

Figure 13:
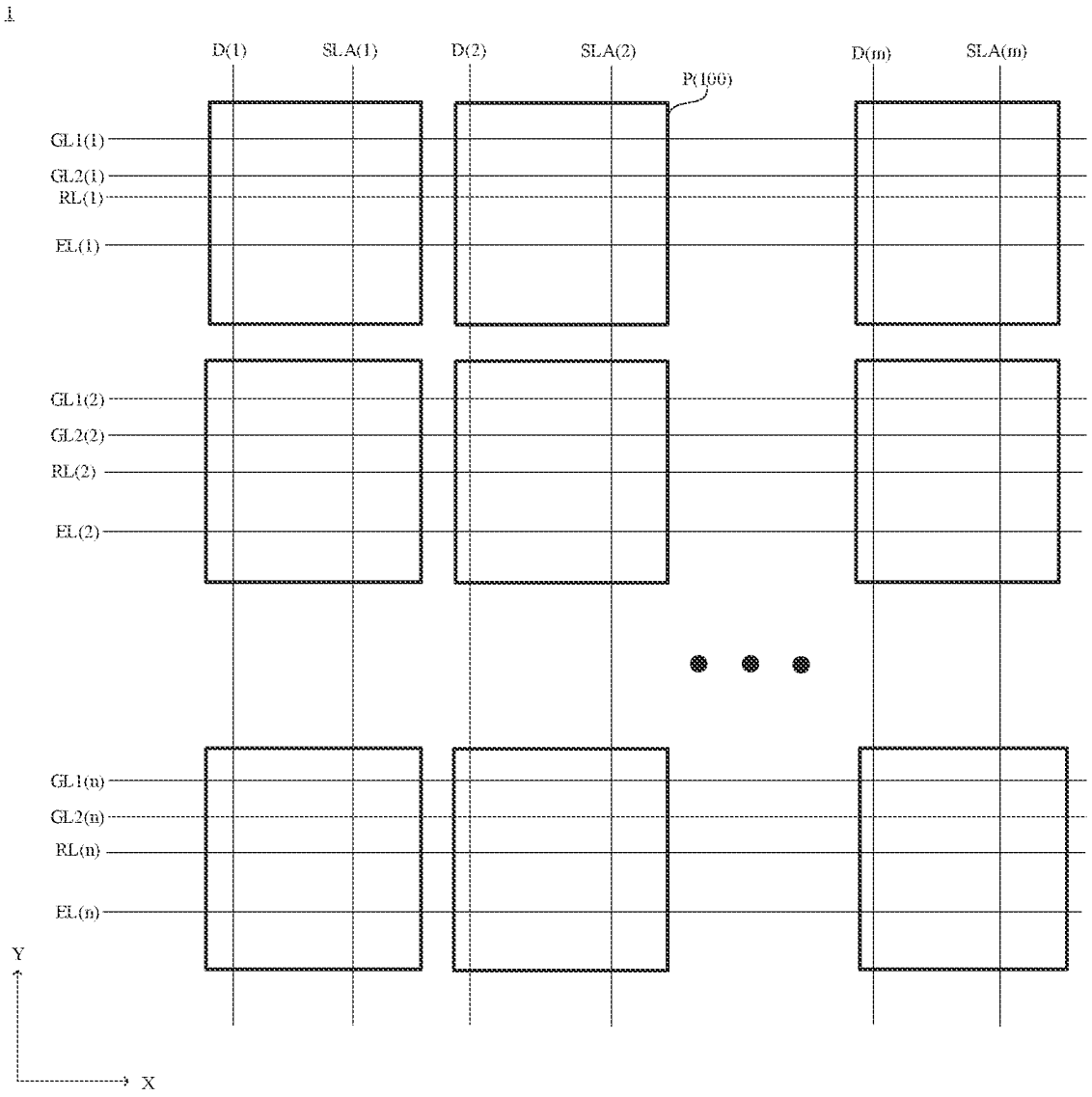
FIG. 13 is a schematic diagram of a display panel, in accordance with some embodiments.

In some examples, as shown in FIG. 13, the plurality of sub-pixel P are arranged in an array of n rows and m columns, and n and m are both positive integers.

For example, as shown in FIG. 13, the display panel 1 further includes: a plurality of first scan signal lines GL1(1) to GL1(*n*), a plurality of second scan signal lines GL2(1) to GL2(*n*), a plurality of reset signal lines RL(1) to RL(n), a plurality of light-emitting control signal lines EL(1) to EL(n), and a plurality of data signal lines DL(1) to DL(m). Each first scan signal line GL1 is configured to provide the first scan signal, each second scan signal line GL2 is configured to provide the second scan signal, each reset signal line RL is configured to provide the reset signal, each light-emitting control signal line EL is configured to provide the light-emitting control signal, and each data signal line DL is configured to provide the data signal.

An extending direction of the plurality of first scan signal lines GL1, an extending direction of the plurality of second scan signal lines GL2, an extending direction of the plurality of reset signal lines RL and an extending direction of the plurality of light-emitting control signal lines EL may be the same, and may be cross an extending direction of the plurality of data signal lines DL. For example, the extending direction of the plurality of first scan signal lines GL1, the extending direction of the plurality of second scan signal lines GL2, the extending direction of the plurality of reset signal lines RL and the extending direction of the plurality of light-emitting control signal lines EL are parallel to the first direction X, and the extending direction of the plurality of data signal lines DL is parallel to the second direction Y.

A first scan signal line GL1, a second scan signal line GL2, a reset signal line RL and a light-emitting control signal line EL are coupled to light-emitting driving circuits 100 in a row of sub-pixels R A data signal line DL is coupled to light-emitting driving circuits 100 in a column of sub-pixels P. For example, a first scan signal line GL1(1), a second scan signal line GL2(1), a reset signal line RL(1), and a light-emitting control signal line EL(1) are coupled to light-emitting driving circuits 100 in a first row of sub-pixels P; a first scan signal line GL1(2), a second scan signal line GL2(2), a reset signal line RL(2) and a light-emitting control signal line EL(2) are coupled to light-emitting driving circuits 100 in a second row of sub-pixels P; . . . ; a first scan signal line GL1(*n*), a second scan signal line GL2(*n*), a reset signal line RL(n) and a light-emitting control signal line EL(n) are coupled to light-emitting driving circuits 100 in an n-th row of sub-pixels P. A data signal line DL(1) is coupled to light-emitting driving circuits 100 in a first column of sub-pixels P, a data signal line DL(2) is coupled to light-emitting driving circuits 100 in a second column of sub-pixels P; . . . ; a data signal line DL(m) is coupled to light-emitting driving circuits 100 in an m-th column of sub-pixels P.

In this case, each first scan signal line GL1 provides the first scan signal to first scan signal terminals Gate1 coupled to the light-emitting driving circuits 100 in corresponding one row of sub-pixels P. Each second scan signal line GL2 provides the second scan signal to second scan signal terminals Gate2 coupled to the light-emitting driving circuits 100 in corresponding one row of sub-pixels P. Each light-emitting control signal line EL provides the light-emitting control signal to light-emitting control signal terminals EM coupled to the light-emitting driving circuits 100 in corresponding one row of sub-pixels P. Each reset signal line RL provides the reset signal to reset signal terminals RST coupled to the light-emitting driving circuits 100 in corresponding one row of sub-pixels P. Each data signal line DL provides the data signal to data signal terminals Data coupled to the light-emitting driving circuits 100 in corresponding one column of sub-pixels P. In this way, the light-emitting driving circuit 100 may receive the first scan signal, the second scan signal, the reset signal, the light-emitting control signal, and the data signal.

In some embodiments, as shown in FIG. 13, the display panel 1 further includes a plurality of first signal lines SLA(1) to SLA(m). Each first signal line SLA is configured to provide the first signal. Each first signal line SLA is coupled to the light-emitting driving circuits 100 in corresponding one column of sub-pixels P. For example, an extending direction of the plurality of first signal lines SLA is the same as the extending direction of the plurality of data signal lines DL, e.g., is parallel to the second direction Y.

In some examples, the first signal transmitted by the first signal line SLA to the light-emitting driving circuit 100 is the same as the data signal transmitted by the data signal line DL to the light-emitting driving circuit 100. That is, the first signal input to the light-emitting driving circuit 100 is the same as the data signal written into the light-emitting driving circuit 100. For example, as shown in FIGS. 7 and 9, the voltage $V_{CTL}$ of the first signal is equal to the voltage $V_{data}$ of the data signal.

In addition, it will be noted that the arrangement of the signal lines described above are only examples, and do not limit the structure of the light-emitting apparatus 2, and a person skilled in the art can design the arrangement of the signal lines according to actual situations.

In some embodiments, referring to FIGS. 11 and 12, the light-emitting apparatus 2 further includes a first driver chip 31, and the first driver chip 31 is coupled to the display panel 1. The first driver chip 31 is configured to provide data signals to the plurality of data signal lines DL of the display panel 1, so that the data signal can be transmitted to the light-emitting driving circuit 100.

In a case where a minimum data voltage output by the first driver chip 31 is 3 mV, the light-emitting driving signal 100 may reduce the minimum data voltage in half. Thus, a minimum voltage of the control electrode of the driving transistor DT may be adjusted to be half of the minimum data voltage, that is, the minimum voltage of the control electrode of the driving transistor DT may be 0.15 mV.

In some embodiments, referring to FIGS. 11 and 12, the light-emitting apparatus 2 further includes a second driver chip 32, and the second driver chip 32 is coupled to the display panel 1. The second driver chip 32 is configured to provide first signals to the plurality of first signal lines SLA of the display panel 1, so that the first signal can be transmitted to the light-emitting driving circuit 100.

In some examples, referring to FIG. 12, the first driver chip and the second driver chip may be provided separately, or referring to FIG. 11, the first driver chip and the second driver chip may be integrated together, e.g., integrated in the same integrated circuit, which is not limited thereto.

In some embodiments, the light-emitting apparatus further includes components such as a system motherboard and a housing.

Some embodiments of the present disclosure provide a driving method of a light-emitting driving circuit. The light-emitting driving circuit is the light-emitting driving circuit 100 in any of the above embodiments. Referring to FIG. 2, the light-emitting driving circuit 100 includes: the driving sub-circuit 10, the data writing sub-circuit 20, the compensation sub-circuit 30 and the control sub-circuit 40.

The driving method includes: initializing, by the control sub-circuit 40, the voltage of the first node M and the voltage of the control terminal G of the driving sub-circuit 10 in response to the second scan signal; writing, by the data writing sub-circuit 20, the data signal into the first terminal of the driving sub-circuit 10 in response to the first scan signal; outputting, from the second terminal of the driving sub-circuit, the data signal written into the first terminal of the driving sub-circuit and the compensation signal; transmitting, by the compensation sub-circuit 30, the data signal and the compensation signal to the first node M in response to the first scan signal; adjusting, by the compensation sub-circuit 30, the voltage of the control terminal G of the driving sub-circuit 10 according to the data signal, the compensation signal, the initialized voltage of the first node M and the initialized voltage of the control terminal G of the driving sub-circuit 10; and outputting, by the driving sub-circuit 10, the driving signal for driving the light-emitting device L to emit light according to the adjusted voltage of the control terminal G of the driving sub-circuit and the first voltage transmitted to the first terminal 101 of the driving sub-circuit 10.

In some embodiments, referring to FIG. 3, the control sub-circuit 40 includes the second switching device 12, the third switching device 13 and the second capacitor C2. In this case, initializing, by the control sub-circuit 40, the first node M and the control terminal G of the driving sub-circuit 10 in response to the second scan signal, includes: transmitting, by the second switching device 12, the first signal to the second node H in response to the second scan signal; transmitting, by the third switching device 13, the second signal to the control terminal G of the driving sub-circuit 10 in response to the second scan signal; and controlling, by the second capacitor C2, the voltage of the first node M according to the voltage of the second node H.

In some examples, the first signal is the same as the data signal. In this case, the voltage $V_{CTL}$ of the first signal is the same as the voltage $V_{data}$ of the data signal. In some examples, the first signal is different from the second signal. In this case, the voltage $V_{CTL}$ of the first signal is different from the voltage $V_{COM}$ of the second signal.

In some embodiments, referring to FIGS. 2, 5A and 5B, the light-emitting driving circuit 100 further includes the reset sub-circuit 60 and the light-emitting control sub-circuit 50. In this case, the driving method further includes: transmitting, by the reset sub-circuit 60, the initialization signal to the control terminal G of the driving sub-circuit 10 in response to the reset signal; transmitting, by the reset sub-circuit 60, the initialization signal to the light-emitting device L in response to the reset signal; transmitting, by the light-emitting control sub-circuit 50, the first voltage to the driving sub-circuit 10 in response to a light-emitting control signal; and transmitting, by the light-emitting control sub-circuit 50, the driving signal to the light-emitting device L in response to the light-emitting control signal.

It will be noted that, for a detailed process of the driving method, reference can be made to the above description of the operating process of the light-emitting driving circuit, which will not be repeated herein. In addition, beneficial effects of the driving method are the same as the beneficial effects of the above light-emitting driving circuit, which will not be described herein.

The foregoing descriptions are merely specific implementations of the present disclosure, but the protection scope of the present disclosure is not limited thereto. Changes or replacements that any person skilled in the art could conceive of within the technical scope of the present disclosure shall all be included in the protection scope of the present disclosure. Therefore, the protection scope of the present disclosure shall be subject to the protection scope of the claims.

What is claimed is:

1. A light-emitting driving circuit, comprising:

a driving sub-circuit;

a control sub-circuit coupled to a first node and a control terminal of the driving sub-circuit;

a data writing sub-circuit coupled to a first terminal of the driving sub-circuit; and a compensation sub-circuit coupled to the first node, the control terminal of the driving sub-circuit and a second terminal of the driving sub-circuit, wherein the control sub-circuit is configured to initialize a voltage of the first node and a voltage of the control terminal of the driving sub-circuit in response to a second scan signal;

the data writing sub-circuit is configured to write a data signal into the first terminal of the driving sub-circuit in response to a first scan signal;

the driving sub-circuit is configured to output, from the second terminal of the driving sub-circuit, the data signal and a compensation signal;

the compensation sub-circuit is configured to transmit the data signal and the compensation signal to the first node in response to the first scan signal, and to adjust the voltage of the control terminal of the driving sub-circuit according to the data signal, the compensation signal, the initialized voltage of the first node and the initialized voltage of the control terminal of the driving sub-circuit;

the compensation sub-circuit includes:

a first switching device coupled between the first node and the second terminal of the driving sub-circuit; and a first capacitor coupled between the first node and the control terminal of the driving sub-circuit; and the driving sub-circuit is further configured to output a driving signal for driving a light-emitting device to emit light according to the adjusted voltage of the control terminal of the driving sub-circuit and a first voltage transmitted to the first terminal of the driving sub-circuit.

2. The light-emitting driving circuit according to claim 1, wherein the control sub-circuit includes:

a second switching device coupled to a second node, wherein the second switching device is configured to transmit a first signal to the second node in response to the second scan signal;

a second capacitor coupled between the first node and the second node; and a third switching device coupled to the control terminal of the driving sub-circuit, wherein the third switching device is configured to transmit a second signal to the control terminal of the driving sub-circuit in response to the second scan signal.

3. The light-emitting driving circuit according to claim 2, wherein the second switching device is a second transistor; and a control electrode of the second transistor is configured to be coupled to a second scan signal terminal for providing the second scan signal, a first electrode of the second transistor is configured to be coupled to a first signal terminal for providing the first signal, and a second electrode of the second transistor is coupled to the second node.

4. The light-emitting driving circuit according to claim 2, wherein the third switching device is a third transistor; and a control electrode of the third transistor is configured to be coupled to a second scan signal terminal for providing the second scan signal, a first electrode of the third transistor is configured to be coupled to a second signal terminal for providing the second signal, and a second electrode of the third transistor is coupled to the control terminal of the driving sub-circuit.

5. The light-emitting driving circuit according to claim 1, wherein the first switching device is a first transistor; and a control electrode of the first transistor is configured to be coupled to a first scan signal terminal for providing the first scan signal, a first electrode of the first transistor is coupled to the second terminal of the driving sub-circuit, and a second electrode of the first transistor is coupled to the first node.

6. The light-emitting driving circuit according to claim 1, wherein the driving sub-circuit includes:

a driving transistor, wherein a control electrode of the driving transistor is the control terminal of the driving sub-circuit, a first electrode of the driving transistor is the first terminal of the driving sub-circuit, and a second electrode of the driving transistor is the second terminal of the driving sub-circuit; and a storage capacitor, wherein a first terminal of the storage capacitor is coupled to the control electrode of the driving transistor, and a second terminal of the storage capacitor is configured to be coupled to a first voltage terminal for providing the first voltage.

7. The light-emitting driving circuit according to claim 1, wherein the data writing sub-circuit includes an eighth transistor;

a control electrode of the eighth transistor is configured to be coupled to a first scan signal terminal for providing the first scan signal, a first electrode of the eighth transistor is configured to be coupled to a data signal terminal for providing the data signal, and a second electrode of the eighth transistor is coupled to the first terminal of the driving sub-circuit.

8. The light-emitting driving circuit according to claim 1, further comprising a light-emitting control sub-circuit coupled to the driving sub-circuit, wherein the light-emitting control sub-circuit is configured to control the driving sub-circuit to be communicated with a first voltage terminal for providing the first voltage and the light-emitting device in response to a light-emitting control signal.

9. The light-emitting driving circuit according to claim 8, wherein the light-emitting control sub-circuit includes a sixth transistor and a seventh transistor;

a control electrode of the sixth transistor is configured to be coupled to a light-emitting control terminal for providing the light-emitting control signal, and a first electrode of the sixth transistor is configured to be coupled to the first voltage terminal, and a second electrode of the sixth transistor is coupled to the first terminal of the driving sub-circuit; and a control electrode of the seventh transistor is configured to be coupled to the light-emitting control terminal, a first electrode of the seventh transistor is coupled to the second terminal of the driving sub-circuit, and a second electrode of the seventh transistor is configured to be coupled to the light-emitting device.

10. The light-emitting driving circuit according to claim 1, further comprising a reset sub-circuit coupled to the control terminal of the driving sub-circuit, wherein the reset sub-circuit is configured to transmit an initialization signal to the control terminal of the driving sub-circuit in response to a reset signal, so as to reset the control terminal of the driving sub-circuit.

11. The light-emitting driving circuit according to claim 10, wherein the reset sub-circuit includes a fifth transistor;

a control electrode of the fifth transistor is configured to be coupled to a reset signal terminal for providing the reset signal, a first electrode of the fifth transistor is configured to be coupled to an initialization signal terminal for providing the initialization signal, and a second electrode of the fifth transistor is coupled to the control terminal of the driving sub-circuit.

12. The light-emitting driving circuit according to claim 10, wherein the reset sub-circuit is further configured to be coupled to the light-emitting device, and to transmit the initialization signal to the light-emitting device in response to the reset signal, so as to reset the light-emitting device.

13. The light-emitting driving circuit according to claim 12, wherein the reset sub-circuit includes:

a fourth transistor, wherein a control electrode of the fourth transistor is configured to be coupled to a reset signal terminal for providing the reset signal, a first electrode of the fourth transistor is configured to be coupled to an initialization signal terminal for providing the initialization signal, and a second electrode of the fourth transistor is configured to be coupled to the light-emitting device; and a fifth transistor, wherein a control electrode of the fifth transistor is configured to be coupled to the reset signal terminal, a first electrode of the fifth transistor is configured to be coupled to the initialization signal terminal, and a second electrode of the fifth transistor is coupled to the control terminal of the driving sub-circuit.

14. The light-emitting driving circuit according to claim 1, further comprising a reset sub-circuit and a light-emitting control sub-circuit, wherein the control sub-circuit includes a second transistor, a third transistor and a second capacitor; a control electrode of the second transistor is configured to be coupled to a second scan signal terminal for providing the second scan signal, a first electrode of the second transistor is configured to be coupled to a first signal terminal for providing a first signal, and a second electrode of the second transistor is coupled to a second node; a control electrode of the third transistor is configured to be coupled to the second scan signal terminal, a first electrode of the third transistor is configured to be coupled to a second signal terminal for providing a second signal, and a second electrode of the third transistor is coupled to the control terminal of the driving sub-circuit; and the second capacitor is coupled to the first node and the second node;

the first switching device is a first transistor; a control electrode of the first transistor is configured to be coupled to a first scan signal terminal for providing the first scan signal, a first electrode of the first transistor is coupled to the second terminal of the driving sub-circuit, and a second electrode of the first transistor is coupled to the first node;

the driving sub-circuit includes a driving transistor and a storage capacitor; a control electrode of the driving transistor is the control terminal of the driving sub-circuit, a first electrode of the driving transistor is the first terminal of the driving sub-circuit, and a second electrode of the driving transistor is the second terminal of the driving sub-circuit; and a first terminal of the storage capacitor is coupled to the control electrode of the driving transistor, and a second terminal of the storage capacitor is configured to be coupled to a first voltage terminal for providing the first voltage;

the data writing sub-circuit includes an eighth transistor; and a control electrode of the eighth transistor is configured to be coupled to the first scan signal terminal, and a first electrode of the eighth transistor is configured to be coupled to a data signal terminal for providing the data signal, and a second electrode of the eighth transistor is coupled to the first terminal of the driving sub-circuit;

the light-emitting control sub-circuit includes a sixth transistor and a seventh transistor; a control electrode of the sixth transistor is configured to be coupled to a light-emitting control terminal for providing a light-emitting control signal, a first electrode of the sixth transistor is configured to be coupled to the first voltage terminal, and a second electrode of the sixth transistor is coupled to the first terminal of the driving sub-circuit; and a control electrode of the seventh transistor is configured to be coupled to the light-emitting control terminal, a first electrode of the seventh transistor is coupled to the second terminal of the driving sub-circuit, and a second electrode of the seventh transistor is configured to be coupled to the light-emitting device; and the reset sub-circuit includes a fourth transistor and a fifth transistor; a control electrode of the fourth transistor is configured to be coupled to a reset signal terminal for providing a reset signal, a first electrode of the fourth transistor is configured to be coupled to an initialization signal terminal for providing an initialization signal, and a second electrode of the fourth transistor is configured to be coupled to the light-emitting device; and a control electrode of the fifth transistor is configured to be coupled to the reset signal terminal, a first electrode of the fifth transistor is configured to be coupled to the initialization signal terminal, and a second electrode of the fifth transistor is coupled to the control terminal of the driving sub-circuit.

15. A light-emitting apparatus, comprising:

a plurality of light-emitting driving circuits according to claim 1; and a plurality of light-emitting devices; wherein the light-emitting driving circuit is coupled to a first electrode of the light-emitting device, and a second electrode of the light-emitting device is coupled to a second voltage terminal for providing a second voltage.

16. A driving method of a light-emitting driving circuit, the light-emitting driving circuit being the light-emitting driving circuit according to claim 1, the driving method comprising:

initializing, by the control sub-circuit, the voltage of the first node and the voltage of the control terminal of the driving sub-circuit, in response to the second scan signal;

writing, by the data writing sub-circuit, the data signal into the first terminal of the driving sub-circuit, in response to the first scan signal;

outputting, from the second terminal of the driving sub-circuit, the data signal and the compensation signal;

transmitting, by the compensation sub-circuit, the data signal and the compensation signal to the first node, in response to the first scan signal;

adjusting, by the compensation sub-circuit, the voltage of the control terminal of the driving sub-circuit according to the data signal, the compensation signal, the initialized voltage of the first node and the initialized voltage of the control terminal of the driving sub-circuit; and outputting, by the driving sub-circuit, the driving signal for driving the light-emitting device to emit light, according to the adjusted voltage of the control terminal of the driving sub-circuit and the first voltage transmitted to the first terminal of the driving sub-circuit.

17. The driving method according to claim 16, wherein the control sub-circuit includes a second switching device, a third switching device and a second capacitor; and initializing, by the control sub-circuit, the voltage of the first node and the voltage of the control terminal of the driving sub-circuit in response to the second scan signal includes:

transmitting, by the second switching device, a first signal to a second node, in response to the second scan signal;

transmitting, by the third switching device, a second signal to the control terminal of the driving sub-circuit, in response to the second scan signal; and controlling, by the second capacitor, the voltage of the first node, according to the voltage of the second node.

18. The driving method according to claim 17, wherein the first signal is the same as the data signal, and the first signal is different from the second signal.

19. The driving method according to claim 16, wherein the light-emitting driving circuit further includes a reset sub-circuit and a light-emitting control sub-circuit; and the driving method further comprises:

transmitting, by the reset sub-circuit, an initialization signal to the control terminal of the driving sub-circuit, in response to a reset signal;

transmitting, by the reset sub-circuit, the initialization signal to the light-emitting device, in response to the reset signal;

transmitting, by the light-emitting control sub-circuit, the first voltage to the driving sub-circuit, in response to a light-emitting control signal; and transmitting, by the light-emitting control sub-circuit, the driving signal to the light-emitting device, in response to the light-emitting control signal.

* * * * *